US010845722B2

(12) United States Patent
Nishikawa et al.

(10) Patent No.: US 10,845,722 B2
(45) Date of Patent: Nov. 24, 2020

(54) TONER AND METHOD FOR PRODUCING TONER

(71) Applicant: CANON KABUSHIKI KAISHA, Tokyo (JP)

(72) Inventors: Koji Nishikawa, Susono (JP); Kosuke Fukudome, Tokyo (JP); Takaaki Furui, Tokyo (JP); Tetsuya Kinumatsu, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/701,260

(22) Filed: Dec. 3, 2019

(65) Prior Publication Data

US 2020/0183296 A1 Jun. 11, 2020

(30) Foreign Application Priority Data

Dec. 10, 2018 (JP) ..... 2018-230658

(51) Int. Cl.
*G03G 9/08* (2006.01)
*G03G 9/097* (2006.01)
*G03G 9/087* (2006.01)

(52) U.S. Cl.
CPC ..... *G03G 9/09716* (2013.01); *G03G 9/08711* (2013.01); *G03G 9/08755* (2013.01)

(58) Field of Classification Search
CPC ..... G03G 9/09716
USPC ..... 430/108.7, 110.1
See application file for complete search history.

(56) References Cited

U.S. PATENT DOCUMENTS

| | | | |
|---|---|---|---|
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,582,401 | B2 | 9/2009 | Ogawa et al. |
| 7,745,089 | B2 | 6/2010 | Okubo et al. |
| 8,603,712 | B2 | 12/2013 | Aoki et al. |

(Continued)

FOREIGN PATENT DOCUMENTS

| | | |
|---|---|---|
| EP | 1 967 911 | 9/2008 |
| EP | 2 837 971 | 2/2015 |

(Continued)

OTHER PUBLICATIONS

U.S. Appl. No. 16/583,945, Kosuke Fukudome, filed Sep. 26, 2019.

(Continued)

*Primary Examiner* — Mark A Chapman
(74) *Attorney, Agent, or Firm* — Venable LLP

(57) ABSTRACT

A toner comprising an external additive and a toner particle including a binder resin, a colorant and inorganic fine particles A, wherein the external additive contains an external additive B, a number average particle diameter of primary particles of the external additive B is 30 to 200 nm, an adhesion index of the external additive B to the toner particle is 0.00 to 3.00, a number average particle diameter of primary particles of the inorganic fine particles A is greater than that of the external additive B, and in SEM observations of the toner under specific condition, the number of particles (Na) of the external additive B in a 2 μm square region of the toner surface and the number of particles (Nb) of the external additive B observed in a state of overlapping with the inorganic fine particles A in the region satisfy Nb/Na of 0.20 or more.

10 Claims, 13 Drawing Sheets

(56) References Cited

U.S. PATENT DOCUMENTS

| | | | |
|---|---|---|---|
| 8,741,519 | B2 | 7/2014 | Watanabe et al. |
| 8,846,284 | B2 | 9/2014 | Kinumatsu et al. |
| 9,034,549 | B2 | 5/2015 | Shiotari et al. |
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,309,349 | B2 | 4/2016 | Watanabe et al. |
| 9,341,970 | B2 | 5/2016 | Yoshiba et al. |
| 9,429,860 | B2 | 8/2016 | Kinumatsu et al. |
| 9,470,993 | B2 | 10/2016 | Nishikawa et al. |
| 9,588,450 | B2 | 3/2017 | Tsuda et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,715,188 | B2 | 7/2017 | Terauchi et al. |
| 9,772,570 | B2 | 9/2017 | Tsuda et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,818 | B2 | 11/2017 | Yoshiba et al. |
| 9,857,713 | B2 | 1/2018 | Kosaki et al. |
| 9,869,943 | B2 | 1/2018 | Aoki et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 2012/0094229 | A1 | 4/2012 | Mine et al. |
| 2015/0037719 | A1 | 2/2015 | Naka et al. |
| 2015/0125790 | A1 | 5/2015 | Hotta et al. |
| 2015/0220013 | A1 | 8/2015 | Nishikawa et al. |
| 2016/0085167 | A1 | 3/2016 | Yoshihara et al. |
| 2016/0161874 | A1 | 6/2016 | Yamazaki et al. |
| 2017/0307993 | A1 | 10/2017 | Sano et al. |
| 2020/0081361 | A1 | 3/2020 | Yoshiba et al. |

FOREIGN PATENT DOCUMENTS

| | | |
|---|---|---|
| JP | 2002-202628 | 7/2002 |
| JP | 2015-045854 | 3/2015 |
| JP | 2015-143838 | 8/2015 |
| JP | 2016-038459 | 3/2016 |
| JP | 2017-173728 | 9/2017 |
| JP | 2018-036596 | 3/2018 |
| WO | 2013/063291 | 5/2013 |
| WO | 2013/100182 | 7/2013 |
| WO | 2013/115412 | 8/2013 |

OTHER PUBLICATIONS

U.S. Appl. No. 16/584,346, Tetsuya Kinumatsu, filed Sep. 26, 2019.
U.S. Appl. No. 16/701,412, Kosuke Fukudome, filed Dec. 3, 2019.
U.S. Appl. No. 16/728,082, Yasuhiro Hashimoto, filed Dec. 27, 2019.
U.S. Appl. No. 16/728,115, Shotaro Nomura, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.
U.S. Appl. No. 16/701,292, Tetsuya Kinumatsu, filed Dec. 3, 2019.

TONER AND METHOD FOR PRODUCING TONER

BACKGROUND OF THE INVENTION

Field of the Invention

The present invention relates to a toner used in an image formation method such as an electrophotography method, and to a method for producing the toner.

Description of the Related Art

Demands have been placed on electrophotographic image forming apparatuses in terms higher speeds, longer service lives and lower energy consumption, and there have been demands for significant improvements in various properties of toners in response to these demands. For toners in particular, there have been demands for significant improvements in quality stability, that is, long term durability, from the perspective of extending service life, and there have been demands for significant improvements in low-temperature fixability from the perspectives of increasing speed and lowering energy consumption.

In the past, there were methods for improving long term durability by externally adding large amounts of inorganic fine particles from the perspective of long-term durability.

Toners inside developing devices receive load between developing sleeves and regulating blades and by stirring members and the like. As a result, external additives readily become embedded at surfaces of toner particles due to loads received inside developing devices as a result of long-term use, and it could sometimes be difficult to achieve satisfactory image density in a later period of long-term use. Furthermore, if large amounts of inorganic fine particles were added, low-temperature fixability could deteriorate, especially on rough paper having a high degree of unevenness.

Imparting a function of a so-called spacer particle that increases the particle size of an external additive has been attempted as a method for suppressing embedding of an external additive without adding large amounts of external additive.

However, in a situation where loads are continuously received inside developing devices for a long period of time, spacer particles migrate from toner particle surfaces and the function of the spacer particle may not be adequately exhibited. Migration of spacer particles means that spacer particles move from toner particles to other toners, components of the developing device, and the like. In addition, attempts have been made to lower the viscosity of toner particles and add crystalline materials in order to improve low-temperature fixability. In the design of such toner particles, loads received inside developing devices during long term use not only caused spacer particles to migrate from toner particle surfaces, but could also cause spacer particles to become embedded in toner particle surfaces.

As a result, it was not easy to obtain a toner which could maintain low-temperature fixability and image density at high levels during long term use.

Japanese Patent Application Publication No. 2017-173728 proposes that by externally adding an external additive having a number average particle diameter of 80 to 300 nm to a toner particle at a high temperature, it is possible to improve chargeability and cleaning properties.

Japanese Patent Application Publication No. 2015-45854 proposes that by externally adding organic-inorganic composite particles having a number average particle diameter of 50 to 500 nm to a toner particle, it is possible to suppress embedding and migration of an external additive over time and improve transferability.

Japanese Patent Application Publication No. 2015-143838 proposes that by externally adding silica fine particles having a number average particle diameter of 40 to 200 nm to a toner particle, it is possible to maintain stable image density over a long period of time and suppress the occurrence of ghosting.

According to these inventions, externally adding an external additive having a large particle diameter achieves certain effects relating to long term stability of toners.

SUMMARY OF THE INVENTION

However, achieving both low-temperature fixability and long-term durability remains a matter for investigation.

The present invention provides a toner that solves the problems mentioned above, and a method for producing the toner.

Specifically, the present invention provides a toner in which by causing an external additive having a large particle diameter to adhere strongly to a toner particle having inorganic fine particles present not at the surface of the toner particle but near the surface of the toner particle, a decrease in image density caused by deterioration in durability is unlikely to occur while low-temperature fixability on rough paper is maintained even if the toner is used for a long time; and a method for producing the toner.

According to the present invention, a toner comprising:

a toner particle that comprises a binder resin, a colorant and inorganic fine particles A; and an external additive, wherein the external additive contains an external additive B, a number average particle diameter of primary particles of the external additive B is from 30 nm to 200 nm, an adhesion index of the external additive B to the toner particle is from 0.00 to 3.00, a number average particle diameter of primary particles of the inorganic fine particles A is greater than the number average particle diameter of primary particles of the external additive B, and in scanning electron microscope observations of the toner, when Na denotes the number of particles of the external additive B in a 2 μm square region of the toner surface, as obtained by image analysis of the toner surface at an accelerating voltage of 1.0 kV and Nb denotes the number of particles of the external additive B that observed in a state of overlapping with the inorganic fine particles A in a 2 μm square region of the toner surface, as obtained by image analysis of the toner surface at an accelerating voltage of 5.0 kV, a value of Nb/Na is at least 0.20 can be provided.

According to the present invention, a toner in which a decrease in image density caused by deterioration in durability is unlikely to occur while low-temperature fixability on rough paper is maintained even if the toner is used for a long time; and a method for producing the toner can be provided.

Further features of the present invention will become apparent from the following description of exemplary embodiments with reference to the attached drawings.

DESCRIPTION OF THE EMBODIMENTS

Figure 1A:
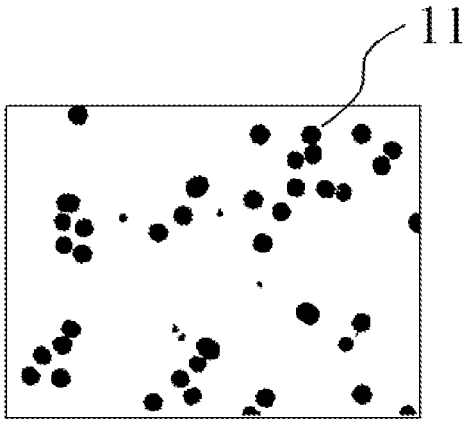
FIGS. 1A to 1C are binarized images of an image obtained by observing a toner surface with a scanning electron microscope.

In the present invention, unless otherwise noted, the terms "from XX to YY" and "XX to YY", which indicate numerical ranges, mean numerical ranges that include the lower limits and upper limits that are the end points of the ranges.

As mentioned above, externally adding a spacer particle is effective as a means for improving long term durability. However, it can be difficult to maintain the initial state of the toner due to spacer particles readily migrating and becoming embedded in toner particle surfaces as a result of loads received in developing devices.

In cases where an external additive is externally added to a toner particle, it can be somewhat difficult to suppress embedding even if a strongly adhered state is achieved by controlling external addition conditions and even if migration of the external additive during long term use can be suppressed.

As a result, the inventors of the present invention considered that in order to suppress embedding of a strongly adhered spacer particle in a toner particle surface, it is effective for inorganic fine particles that are larger than the number average particle diameter of the spacer particle to be present close to the surface of the toner particle.

As a result of repeated investigations, the inventors of the present invention found that it was important to control the positional relationship between a strongly adhered spacer particle and inorganic fine particles which are larger than the number average particle diameter of the spacer particle and which are present close to the surface of the toner particle. The inventors of the present invention found that a decrease in image density caused by deterioration in durability is unlikely to occur while low-temperature fixability on rough paper is ensured even if the toner is used for a long time.

Specifically, the inventors of the present invention find that a decrease in image density caused by deterioration in durability becomes unlikely to occur while low-temperature fixability on rough paper is maintained even if the toner is used for a long time, thanks to a toner comprising:

a toner particle that includes a binder resin, a colorant and inorganic fine particles A; and an external additive, wherein the external additive contains an external additive B, a number average particle diameter of primary particles of the external additive B is 30 to 200 nm, an adhesion index of the external additive B to the toner particle is 0.00 to 3.00, a number average particle diameter of primary particles of the inorganic fine particles A is greater than a number average particle diameter of primary particles of the external additive B, and in scanning electron microscope observations of the toner, when Na denotes the number of particles of the external additive B in a 2 μm square region of the toner surface, as obtained by image analysis of the toner surface at an accelerating voltage of 1.0 kV and Nb denotes the number of particles of the external additive B that observed in a state of overlapping with the inorganic fine particles A in a 2 μm square region of the toner surface, as obtained by image analysis of the toner surface at an accelerating voltage of 5.0 kV, a value of Nb/Na is at least 0.20.

The toner of the present invention is such that in scanning electron microscope observations, if Na denotes the number of particles of the external additive B in a 2 μm square region of the toner surface, as obtained by image analysis of the toner surface at an accelerating voltage of 1.0 kV and Nb denotes the number of particles of the external additive B that observed in a state of overlapping with the inorganic fine particles A in a 2 μm square region of the toner surface, as obtained by image analysis of the toner surface at an accelerating voltage of 5.0 kV, the value of Nb/Na is at least 0.20, preferably at least 0.30, and more preferably at least 0.4. The value of Nb/Na is preferably not more than 1.00.

In observations of the toner surface using a scanning electron microscope, the accelerating voltages are 1.0 kV and 5.0 kV.

Cases where the accelerating voltage is 1.0 kV lead to observations of the vicinity of the outermost surface of the toner. Under this condition, it is possible to confirm the presence of external additive B11 through image analysis (see FIG. 1A), and it is possible to determine the number Na of particles of the external additive B11 by binarizing the image.

Figure 1B:
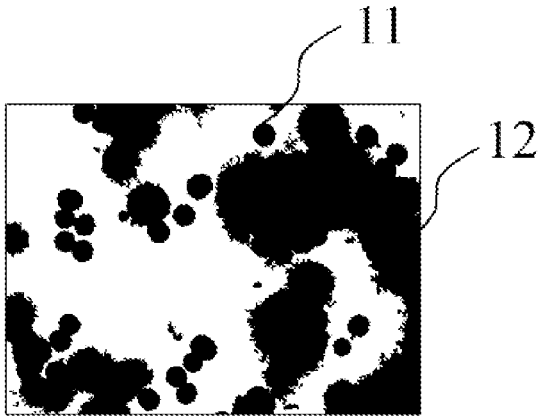

In cases where the accelerating voltage is 5.0 kV, it is possible to observe inorganic fine particles A12 that are present inside the toner particle surface, not only in the vicinity the outermost surface of the toner. Under this condition, it is possible to confirm the external additive B11 and inorganic fine particles A12 through binarization by means of image analysis (see FIG. 1B). However, it is not possible to identify the external additive B11 that observed in a state of overlapping with inorganic fine particles A12 in this binarized image.

Figure 1C:
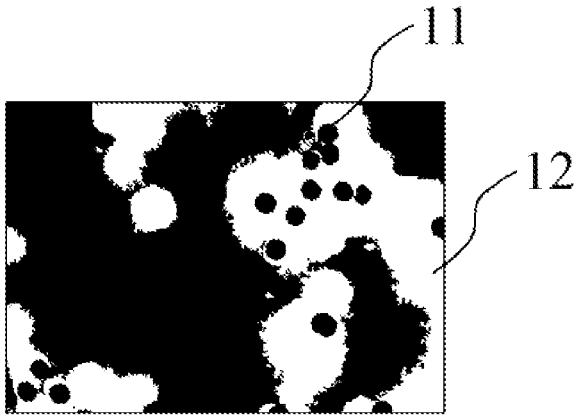

Exactly the same part of the vicinity of the outermost surface of the toner is observed at accelerating voltages of 1.0 kV and 5.0 kV. Using a binarized image obtained at an accelerating voltage of 5.0 kV and a binarized image obtained at an accelerating voltage of 1.0 kV, it is possible deduct the binarized images and find the difference between the images. As a result, it is possible to differentiate the external additive B11 that observed in a state of overlapping with inorganic fine particles A present inside the toner surface on a scanning electron microscope image (see FIG. 1C), and it is possible to determine the number Nb of particles of the external additive.

In the toner, the number average particle diameter of primary particles of the external additive B is from 30 nm to 200 nm, the adhesion index of the external additive B to the toner particle is from 0.00 to 3.00, and the value of Nb/Na is at least 0.20. As a result, a decrease in image density caused by deterioration in durability is unlikely to occur while low-temperature fixability on rough paper is ensured.

The number average particle diameter of primary particles of the external additive B is preferably from 50 nm to 160 nm, and more preferably from 60 nm to 140 nm.

In addition, the adhesion index of the external additive B to the toner particle is preferably from 0.00 to 2.50, and more preferably from 0.00 to 2.10.

The adhesion index of the external additive B is used as an indicator of the state of adhesion of the external additive B to a toner particle. The following is a means for calculating the adhesion index of the external additive B.

First, a toner is brought into contact with a substrate, and the amount of the external additive B that migrates to the substrate when a certain force is applied is calculated using image analysis. The amount of the external additive B that migrates to the substrate is expressed by the areal ratio [A] of the external additive on the substrate. If the external additive B adheres strongly to the toner particle, the external additive B does not migrate to the substrate even when the toner is brought into contact with the substrate, meaning that the areal ratio [A] of the external additive B is a low value.

Meanwhile, because the areal ratio [A] of the external additive B depends on the amount of the external additive B present at the surface of the toner particle, normalization is required in order to obtain an index. In the present invention, the coverage ratio [B] of the external additive B on a toner particle is first determined through observations, and the adhesion index of the external additive B is then calculated from the areal ratio [A] of the external additive B on the substrate and the coverage ratio [B] of the external additive B using the formula below.

Adhesion index of external additive $B$=areal ratio [$A$] of external additive $B$ on substrate/coverage ratio [$B$] of external additive $B$×100

As the adhesion index of the external additive B decreases, the external additive B adheres more strongly to a toner particle. Detailed conditions will be explained later.

The inventors of the present invention think that the reason why the advantageous effect of the present invention is achieved by strongly adhered external additive B and inorganic fine particles A being observed in a state of overlapping is as follows.

First, an explanation will be given of the mechanism by which an advantageous effect relating to long term durability is achieved.

The external additive B is subjected to a force in a developing device. At the same time, stress is generated from the external additive B towards the toner particle, and is transmitted to the inside of the toner particle. In general, if this stress is generated, that part of the toner particle that has been subjected to the stress readily deforms and the external additive B is readily embedded.

If inorganic fine particles A are present close to the surface of the toner particle, as in the present invention, stress generated from the external additive B is transmitted to the inorganic fine particles A. However, if the inorganic fine particles A are so hard as not to deform under the stress, transmission of the stress ends at this point. As a result, embedding of the external additive B is suppressed. As a result, it is thought that the external additive B is unlikely to become embedded even during long term use.

Next, an explanation will be given of the mechanism by which an advantageous effect relating to low-temperature fixability is achieved.

It is known that, in general, low-temperature fixability decreases as the coverage ratio of an external additive on a toner particle increases. This is thought to be because the external additive becomes embedded in the surface of the molten toner particle, meaning that the viscosity inside the surface of the toner particle increases due to the filler effect.

In a fixing step, fixing of the toner on a paper progresses as a result of heat and pressure from a fixing unit. In the filler effect, even if the viscosity inside the surface of the toner particle increases, the force of the pressure of the fixing unit is unlikely to be affected by the increase in viscosity. However, in the case of paper such as rough paper having a high degree of unevenness, toner present in depressed portions is hardly affected by pressure from the fixing unit, and depends mainly on the effect of heat. In such cases, a decrease in fixing performance due to the filler effect tends to be experienced.

The filler effect greatly affects the coverage ratio of the external additive present at the toner particle surface, but it is thought that inorganic fine particles A present in the toner particle surface, as in the present invention, are also slightly affected. Therefore, it is thought that it is preferable for the external additive B and the inorganic fine particles A to be observed in a state of overlapping in a scanning electron microscope image from the perspectives of not increasing the coverage ratio of these particles at the toner surface and inside the toner particle surface and suppressing the impact on fixing performance.

In cases where the adhesion index of the external additive B is greater than 3.00, the external additive B readily moves on the toner particle during long term use. Even if the value of Nb/Na is at least 0.20 as an initial toner state, in cases where the external additive B migrates to parts where there is not observed in a state of overlapping with inorganic fine particles A, embedding progresses, meaning that a decrease in image density caused by deterioration in durability readily occurs and low-temperature fixability tends to decrease following long-term use.

In cases where the value of Nb/Na is less than 0.20, embedding of the external additive B progresses during long term use, meaning that a decrease in image density caused by deterioration in durability readily occurs and low-temperature fixability tends to decrease following long-term use.

In cases where the number average particle diameter of primary particles of the external additive B is less than 30 nm, the function as a spacer particle weakens, meaning that a decrease in image density caused by deterioration in durability readily occurs. In cases where the number average particle diameter of primary particles of the external additive B is greater than 200 nm, the external additive B readily migrates due to loads received in a developing device.

In cases where the toner is observed using a scanning electron microscope at an accelerating voltage of 5.0 kV and inorganic fine particles A present in the toner surface cannot be observed, the external additive B readily becomes embedded and a decrease in image density caused by deterioration in durability readily occurs.

An explanation will now be given of a preferred method for producing the toner of the present invention.

In order for the external additive B to strongly adhere to the toner surface and increase the degree of overlap with the inorganic fine particles A (Nb/Na), it is preferable to lower the adhesion index by means of heat while maintaining a state whereby the external additive B is dispersed at the toner surface. It is thought that by applying heat, the toner surface slightly deforms and the area of contact with the external additive B increases, meaning that the adhesion index decreases.

If an attempt is made to lower the adhesion index simply by means of a mechanical impact force without applying heat, adhesion of the external additive B is unlikely to progress at a position where the inorganic fine particles A and the external additive B being observed in a state of overlapping due to stress propagation. As a result, if an attempt is made to adhere the external additive B by means of a mechanical impact force, adhesion tends to progress at a location where the external additive B has migrated from a position where being observed in a state of overlapping with the inorganic fine particles A does not occur.

In addition to the method mentioned above, the value of Nb/Na can be adjusted, as appropriate, by controlling the shape factor SF-2 of the external additive B.

Heating in an external addition step (a step for mixing the toner particle with the external additive B) or providing a heating step following the external addition step is preferred in a production method for obtaining the toner of the present invention. Providing a heating step following the external addition step is particularly preferred in order to achieve the advantageous effect of the present invention.

In order to achieve a desired adhesion index for the external additive B, it is preferable to set the temperature $T_R$ in the heating step to be similar to the glass transition temperature Tg of the toner particle.

Specifically, if the glass transition temperature of the toner particle is denoted by Tg (° C.), the temperature $T_R$ in the heating step is preferably such that $Tg-10$ (° C.)$\leq T_R \leq Tg+5$ (° C.), and more preferably such that $Tg-5$ (° C.)$\leq T_R \leq Tg+5$ (° C.). The heating time is not particularly limited, but is preferably 3 to 30 minutes, and more preferably 3 to 10 minutes.

In addition, from the perspective of storability, the glass transition temperature Tg of the toner particle is preferably 40° C. to 70° C., and more preferably 50° C. to 65° C.

An apparatus having a mixing function is preferred as the apparatus used in the heating step. A publicly known mixing process apparatus can be used as the apparatus having a mixing function, but the mixing process apparatus 1 shown in FIG. 2 is particularly preferred.

Figure 2:
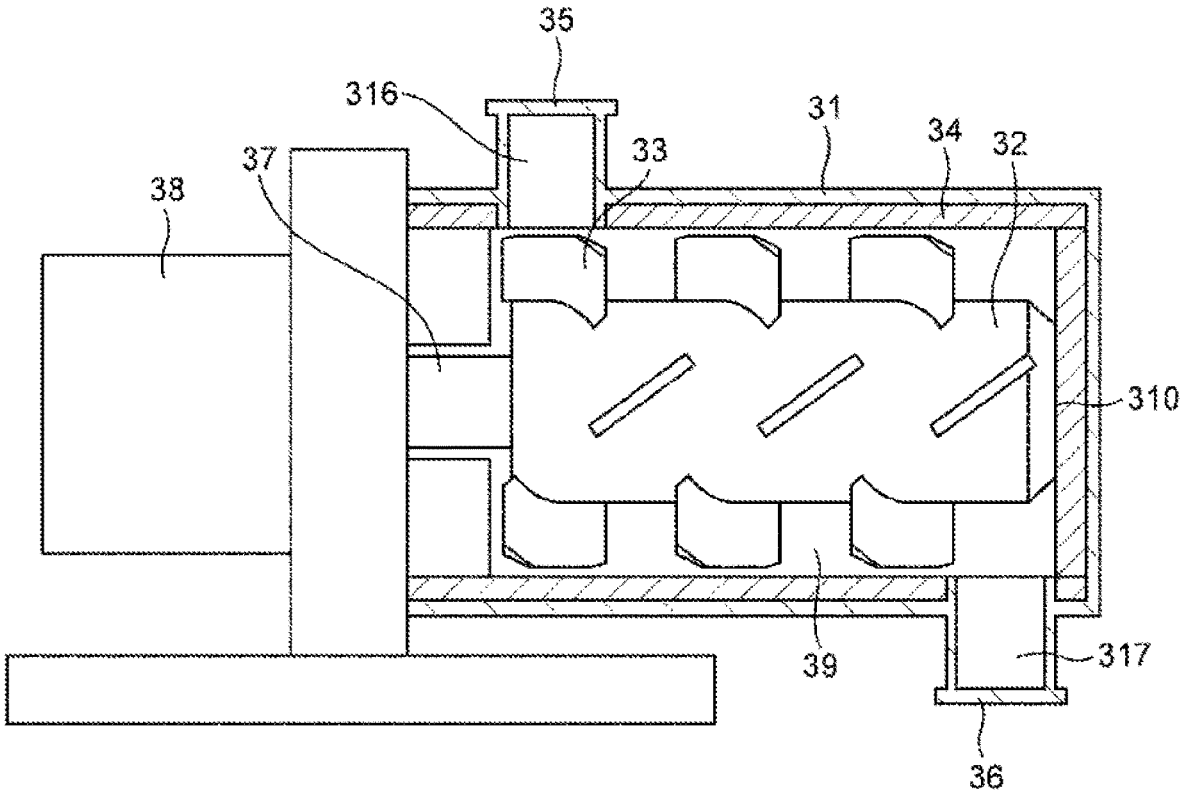
FIG. 2 is a schematic diagram that shows one example of a mixing process apparatus 1.

FIG. 2 is a schematic diagram that shows one example of the mixing process apparatus 1 able to be used in the heating step.

Figure 3:
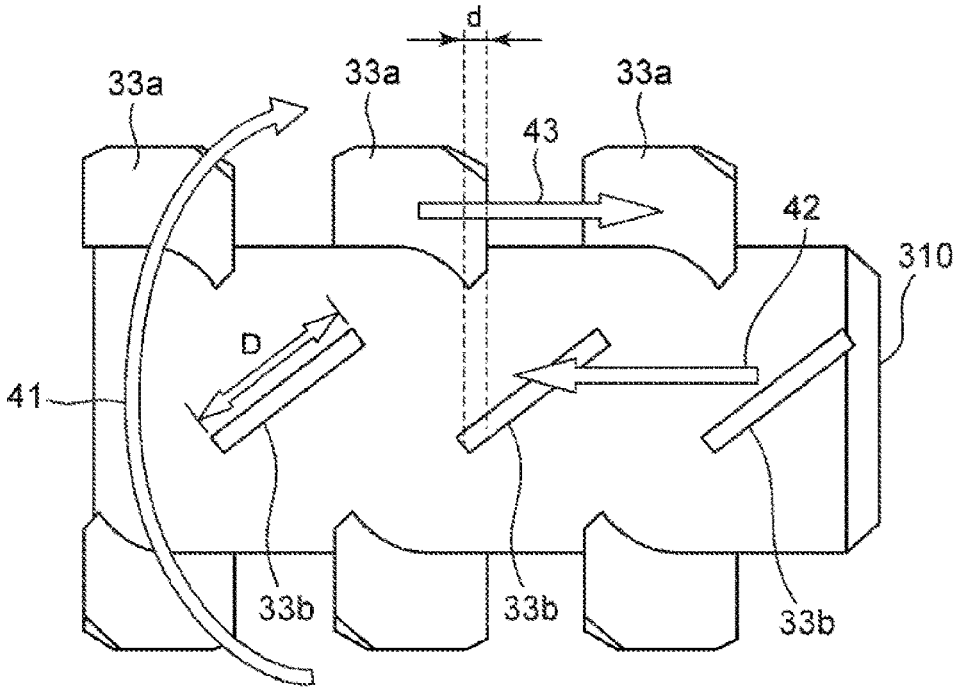
FIG. 3 is a schematic diagram that shows one example of the configuration of a stirring member used in the mixing process apparatus 1.

Meanwhile, FIG. 3 is a schematic diagram that shows one example of the configuration of a stirring member used in the mixing process apparatus 1.

Mixing process apparatus 1 has a rotating member 32 having at least a plurality of stirring members 33 disposed on the surface thereof, a drive member 38 that drives and rotates the rotating member, and a main body casing 31, which is provided in such a way that there is a gap between the main body casing and the stirring members 33.

In the gap (clearance) between the inner periphery of the main body casing 31 and the stirring members 33, heat is effectively applied to the toner, a shearing force is uniformly applied to toner particles, and the external additive B can be adhered to surfaces of the toner particles while breaking down the external additive B from secondary particles into primary particles.

In addition, in the mixing process apparatus 1, the diameter of the inner periphery of the main body casing 31 is not more than twice the diameter of the outer periphery of the rotating member 32. FIG. 2 shows an example in which the diameter of the inner periphery of the main body casing 31 is 1.7 times the diameter of the outer periphery of the rotating member 32 (the diameter of the shaft, excluding the stirring members 33 on the rotating member 32). If the diameter of the inner periphery of the main body casing 31 is not more than twice the diameter of the outer periphery of the rotating member 32, the processing space in which a force acts on the toner is suitably limited, meaning that the external additive B can be efficiently adhered to a toner particle surface.

In addition, the clearance mentioned above can be adjusted according to the size of the main body casing. Making the size of the clearance approximately 1% to 5% of the diameter of the inner periphery of the main body casing 31 is preferred from the perspective of applying heat efficiently to the toner. Specifically, the clearance should be approximately 2 to 5 mm in cases where the diameter of the inner periphery of the main body casing 31 is approximately 130 mm, and the clearance should be approximately 10 to 30 mm in cases where the diameter of the inner periphery of the main body casing 31 is approximately 800 mm.

As shown in FIG. 3, at least some of the plurality of stirring members 33 are formed as feed stirring members 33*a* that feed the toner in one direction of the axial direction of the rotating member 32 due to the rotation of the rotating member. In addition, at least some of the plurality of stirring members 33 are formed as return stirring members 33*b* that return the toner in the other direction of the axial direction of the rotating member 32 due to the rotation of the rotating member. Here, in cases where a raw material inlet port 35 and a product discharge port 36 are provided at the ends of the main body casing 31, as shown in FIG. 2, the direction from the raw material inlet port 35 towards the product discharge port 36 (towards the right in FIG. 2) is referred to as the "feed direction".

That is, a plate face of a feed stirring member 33*a* is inclined so as to feed the toner in the feed direction 43, as shown in FIG. 3. Meanwhile, a plate face of a return stirring member 33*b* is inclined so as to feed the toner in the return direction 42. Due to this configuration, heating is carried out while repeatedly feeding in the "feed direction" 43 and feeding in the "return direction" 42.

In addition, in the stirring members 33*a* and 33*b*, a plurality of members, which are spaced in the circumferential direction of the rotating member 32, form a set. In the example shown in FIG. 3, two stirring members 33*a* and 33*b* form a set spaced at an angle of 180° relative to the rotating member 32, but it is possible for multiple members to form a set, such as three members spaced at angles of 120° or four members spaced at angles of 90°.

In the example shown in FIG. 3, a total of 12 equally spaced stirring members 33*a* and 33*b* are formed.

Furthermore, in FIG. 3, D indicates the width of a stirring member and d indicates an overlapping portion between stirring members. From the perspective of efficiently feeding the toner in the feed direction and return direction, D is preferably approximately 20% to 30% of the length of the rotating member 32 in FIG. 3. FIG. 3 shows an example in which D is 23% of the length of the rotating member. Furthermore, if a line of extension is drawn in a vertical direction from the end of a stirring member 33*a*, stirring members 33*a* and 33*b* preferably have an overlapping portion d between the stirring member 33*b* and the stirring member 33*a*.

Due to this configuration, it is possible for the external additive B to efficiently adhere to the toner particle surface.

It is preferable for the ratio of d relative to D to be 10% to 30% from the perspective of applying a shearing force.

Moreover, in addition to the shape shown in FIG. 3, the shape of a vane may be curved or a paddle structure in which an end vane portion is connected to the rotating member 32 by means of a rod-like arm, as long as it is possible to feed the toner in the feed direction and return direction and maintain clearance.

More detailed explanations will now be given using the schematic diagrams of the apparatus shown in FIG. 2 and FIG. 3.

The apparatus shown in FIG. 2 has a rotating member 32 having at least a plurality of stirring members 33 disposed on the surface thereof, a drive member 38 that drives and rotates the rotating member 32, and a main body casing 31, which is provided in such a way that there is a gap between the main body casing and the stirring members 33. Furthermore, the apparatus has a jacket 34, which is located on the inside of the main body casing 31 and is adjacent to an end side face 310 of the rotating member, and in which a cooling/heating medium can flow.

Furthermore, the apparatus shown in FIG. 2 has the raw material inlet port 35, which is formed in the upper part of the main body casing 31, and the product discharge port 36, which is formed in the lower part of the main body casing 31. The raw material inlet port 35 is used to introduce the toner, and the product discharge port 36 is used to discharge the heated and mixed toner from the main body casing 31 to the outside.

Furthermore, the apparatus shown in FIG. 2 is such that an inner piece 316 for the raw material inlet port is inserted into the raw material inlet port 35, and an inner piece 317 for the product discharge port is inserted into the product discharge port 36.

First, the inner piece 316 for the raw material inlet port is removed from the raw material inlet port 35, the toner is introduced into a processing space 39 from the raw material inlet port 35, and the inner piece 316 for the raw material inlet port is then inserted. Next, the rotating member 32 is rotated by the drive member 38 (41 indicates the direction of rotation), and an introduced processing subject is heated and mixed while being stirred and mixed by the plurality of stirring members 33 provided on the surface of the rotating member 32.

Heating can be carried out by passing water having a prescribed temperature through the jacket 34. The temperature of the water can be monitored using a thermocouple (not shown) disposed inside the inner piece 316 for the raw material inlet port. In order to stably obtain the toner of the present invention, the temperature $T_R$ (° C., thermocouple temperature) inside the inner piece 316 for the raw material inlet port is preferably such that Tg−10 (° C.)≤$T_R$≤Tg+5 (° C.), and more preferably such that Tg−5 (° C.)≤$T_R$≤Tg+5 (° C.).

Heating and mixing conditions are such that the power of the drive member 38 is preferably controlled to $1.0\times10^{-3}$ to $1.0\times10^{-1}$ W/g, and more preferably $5.0\times10^{-3}$ to $5.0\times10^{-2}$ W/g.

In order to increase the degree of overlap with inorganic fine particles A (Nb/Na) while strongly adhering the external additive B, it is preferable to apply no mechanical impact force whatsoever to the toner. Meanwhile, in order to unify the coated state of the external additive B, minimal power is required, and is preferably controlled within the range mentioned above.

The power of the drive member 38 is a value obtained by subtracting the empty power (W) for operating the apparatus when no toner has been introduced from the power (W) for operating the apparatus when toner has been introduced, and dividing by the amount (g) of toner introduced.

The processing time depends on the heating temperature, and is therefore not particularly limited, but is preferably 3 to 30 minutes, and more preferably 3 to 10 minutes. By controlling the processing time within the range mentioned above, toner strength and adhesion can be achieved.

The speed of rotation of the stirring members is linked to the power mentioned above, and is not particularly limited. In the apparatus shown in FIG. 2, in which the volume of the processing space 39 is $2.0\times10^{-3}$ $m^3$, the speed of rotation of the stirring members is preferably 0.83 to 8.30 $S^{-1}$ if the shape of the stirring members 33 is as shown in FIG. 3. This speed of rotation is more preferably 1.67 to 5.00 $S^{-1}$.

Following completion of the heating and mixing, the inner piece 317 for the product discharge port is removed from the product discharge port 36, the rotating member 32 is rotated by the drive member 38, and the toner can be discharged from the product discharge port 36. If necessary, coarse grains of toner may be separated using a sieving machine such as a circular vibrating sieving machine.

In cases where the external additive B is adhered by means of heating using the mixing process apparatus 1, it is preferable to externally add the external additive B in advance in the external addition step.

It is possible to obtain a toner in which the external additive B is externally added to the toner particle by using a publicly known mixing machine such as an FM Mixer (available from Nippon Coke & Engineering Co., Ltd.), a Super Mixer (available from Kawata Mfg. Co., Ltd.), a Nobilta (available from Hosokawa Micron Corporation) or a Hybridizer (available from Nara Machinery Co., Ltd.) in the external addition step. At this point, the adhesion index of the external additive B is high even if the value of Nb/Na is at least 0.20.

By operating the mixing process apparatus 1 under the conditions described above, it is possible to adjust the degree of overlap between the strongly adhered external additive B and the inorganic fine particles A (Nb/Na) in the manner of the present invention in the subsequent heating step. In cases where almost no mechanical impact force is applied, it is thought that adhesion of the external additive B by heat depends on the frequency of contact between the toner and heated parts, such as internal walls of the apparatus. From such a perspective, the mixing process apparatus 1 exhibits excellent toner mixing properties.

By heating the toner of the present invention in the external addition step, it is possible to carry out external addition and adhesion in a single step. In cases where external addition and adhesion are carried out in a single step, it is possible to use a publicly known mixing process apparatus, but it is preferable to use mixing process apparatus 2, which is shown in FIG. 4.

Figure 4:
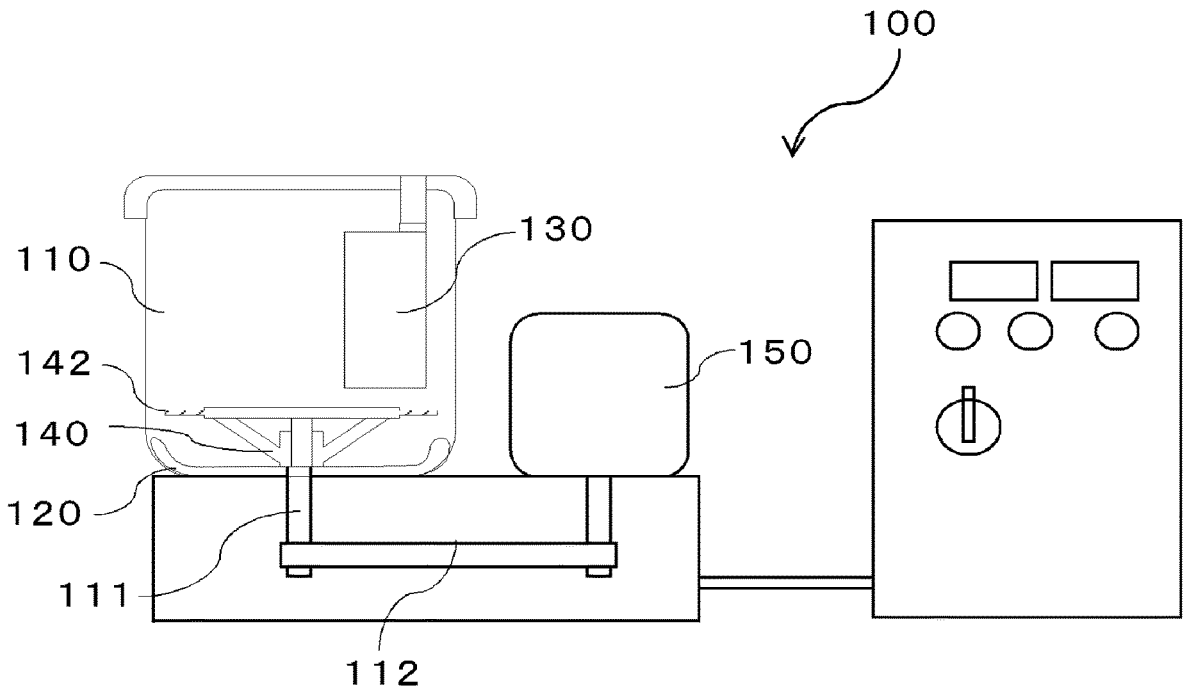
FIG. 4 is a schematic diagram that shows one example of mixing process apparatus 2.

FIG. 4 is a schematic view of a mixing process apparatus 2.

The mixing process apparatus 2 comprises a processing tank 110 as a processing chamber that houses a processing subject containing the toner particle and the external additive B, and the like, a stirring vane 120 as a fluidizing means provided in a rotatable manner on the bottom of the processing tank 110, and a processing vane 140 as a rotating member provided in a rotatable manner above the stirring vane 120. Furthermore, a deflector 130 that is fixed to the processing tank 110 is, if necessary, provided above the processing vane 140.

Figure 5:
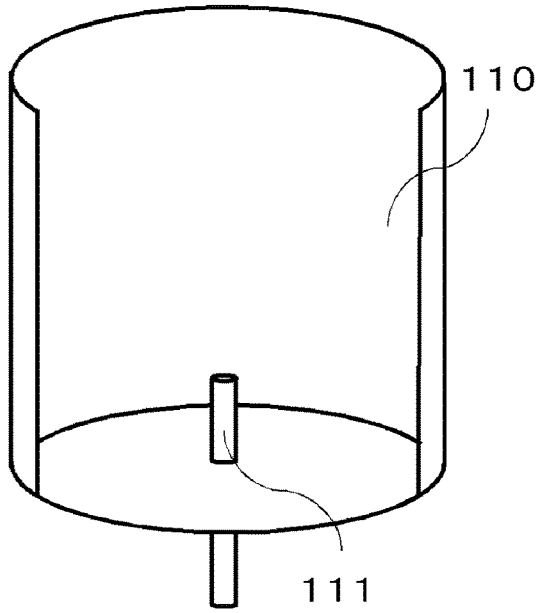
FIG. 5 is a schematic view of a processing tank.

FIG. 5 is a schematic view of the processing tank 110. The processing tank 110 is a circular cylindrical container having a flat bottom, and a drive shaft 111 is provided for attaching the stirring vane 120 and the processing vane 140 to the approximate center of the bottom. From the perspective of strength, the processing tank 110 is preferably made from a metal such as iron or SUS. It is preferable for the inner surface of the processing tank 110 to be an electrically conductive material, or for the inner surface to be subjected to an electrical conductivity treatment. In addition, the processing tank 110 may have a jacket (not shown) in which a cooling/heating medium can flow.

Figure 6A:
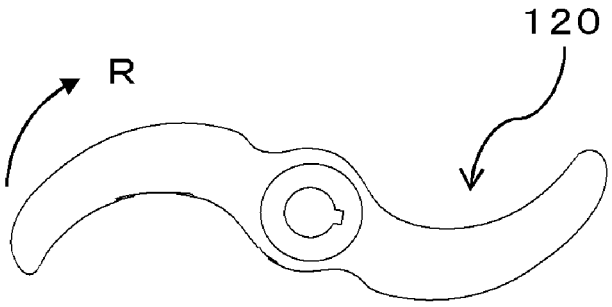
FIGS. 6A and 6B are schematic views of a stirring vane.
Figure 6B:
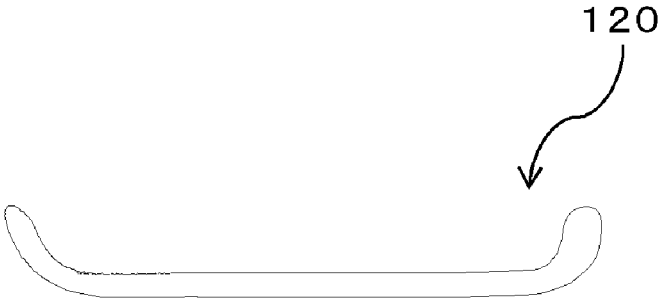

FIGS. 6A and 6B are schematic views of the stirring vane 120. FIG. 6A is a planar view and FIG. 6B is a frontal view. In the present invention, the stirring vane 120 causes the processing subject to flow (rise up) inside the processing tank 110.

The stirring vane 120 has vane parts that extend outwards from the center. The shape of the vane parts can be designed, as appropriate, according to the size and operating conditions of the mixing process apparatus 2 and the charged amount and specific gravity of the processing subject. The tips of the vane parts preferably have an upwardly curving shape so as to force the processing subject upwards.

The stirring vane 120 is preferably made from a metal such as iron or SUS from the perspective of strength, and may, if necessary, be plated or coated in order to improve abrasion resistance.

The stirring vane 120 is fixed to the drive shaft 111 at the bottom of the processing tank 110 and rotates in a clockwise direction R when seen from above. Due to the rotation of the stirring vane 120, the processing subject rises while rotating in a clockwise direction inside the processing tank 110, and then descends due to gravity, and it is thought that the processing subject can therefore be uniformly mixed.

Figure 7A:
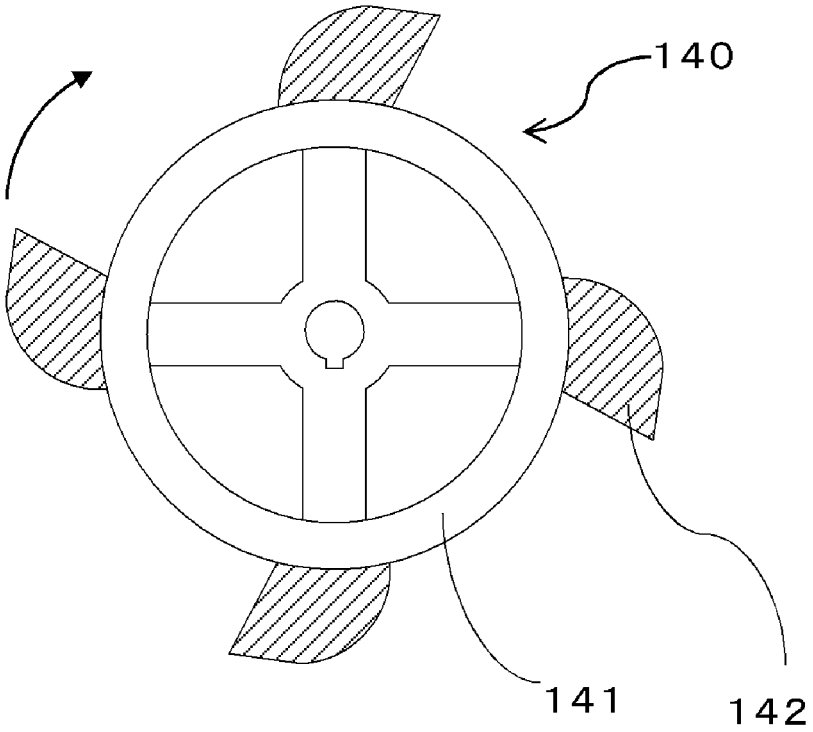
FIGS. 7A and 7B are schematic views of a processing vane.
Figure 7B:
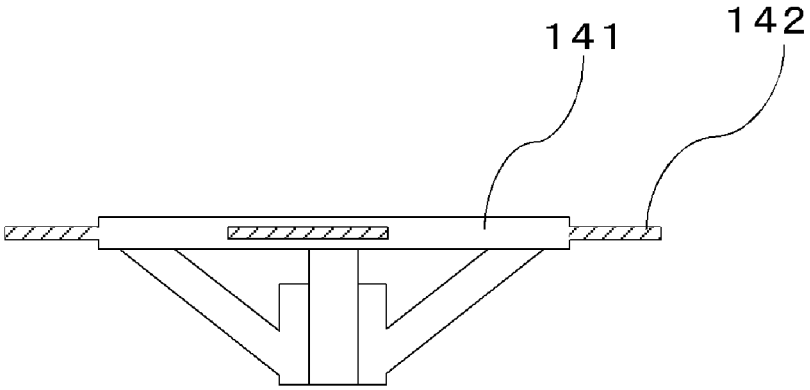

FIGS. 7A and 7B are schematic views of the processing vane 140. FIG. 7A is a planar view and FIG. 7B is a frontal view. The processing vane 140 processes the processing subject by impacting on the flowing processing subject.

The processing vane 140 is constituted from an annular main body 141 and processing sections 142 that protrude outwards in a radial direction from the outer peripheral surface of the main body 141. The processing vane 140 is preferably made from a metal such as iron or SUS from the perspective of strength, and may, if necessary, be plated or coated in order to improve abrasion resistance.

Figure 8:
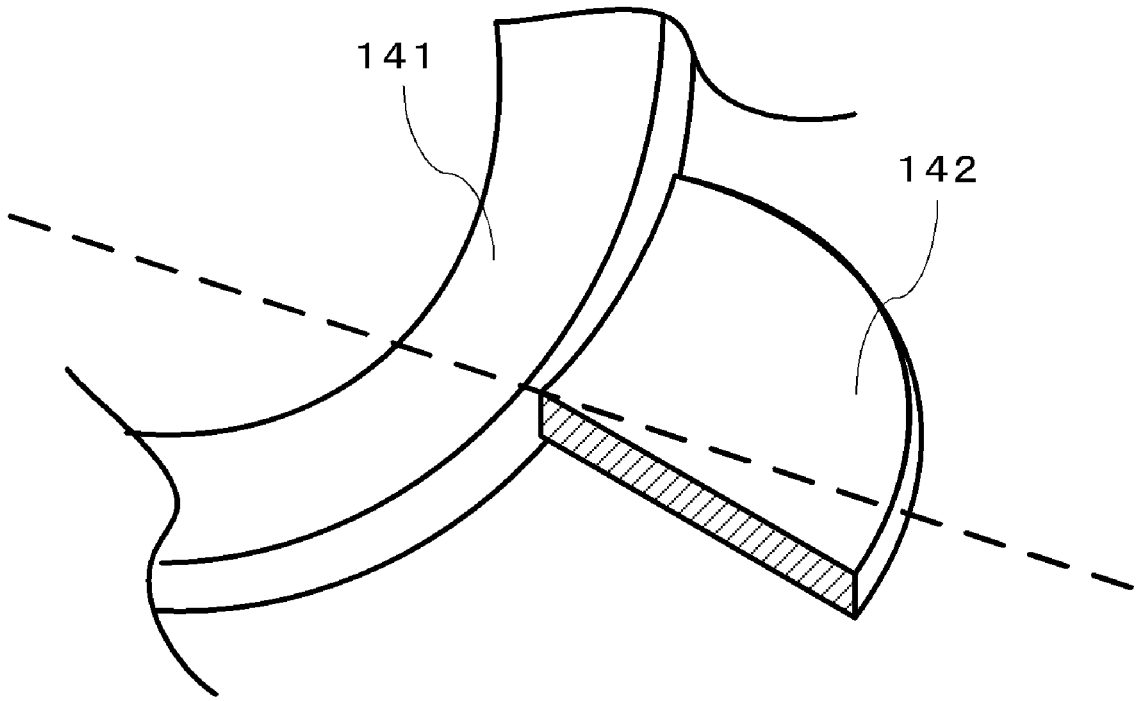
FIG. 8 is a perspective view of a processing section.

FIG. 8 is a perspective view of the processing section 142. Within the processing section 142, a processing face that mainly impacts with the processing subject on the downstream side in the direction of rotation of the processing vane 140 is shown by an oblique line.

The area of the processing face is preferably adjusted, as appropriate, in view of the size and operating conditions of the mixing process apparatus 2 and the charged amount and specific gravity of the processing subject so that the adhesion index of the external additive B falls within the prescribed range.

Figure 9:
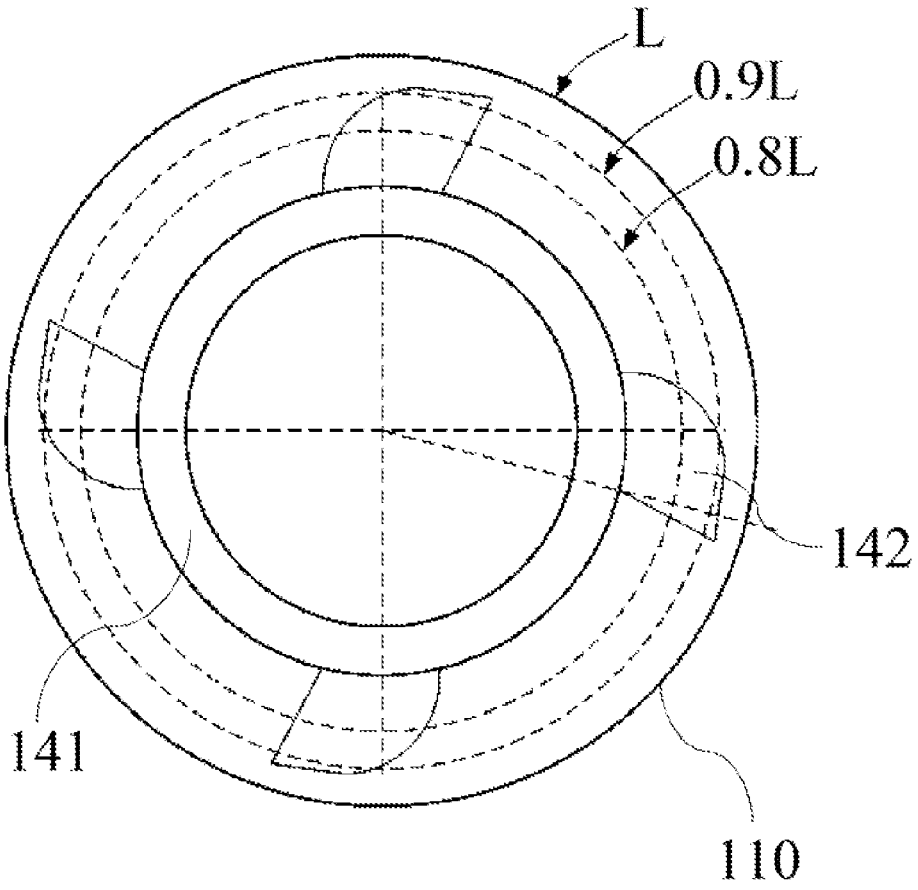
FIG. 9 is a diagram that shows the relationship between a processing vane and a processing tank.

FIG. 9 is a diagram that shows the relationship between the processing vane and the processing tank, and shows a cross section that supposes a case in which the processing vane 140 is cut to a flat surface that is orthogonal to the drive shaft and passes through the processing section 142. The processing vane 140 in FIG. 9 rotates in a clockwise direction.

The processing face protrudes outwards in a radial direction from the outer peripheral surface of the main body 141, as shown in FIG. 9, and a region on the processing face that is distant from the main body 141 is formed so as to be positioned further downstream in the direction of rotation of the processing vane 140 than a region on the processing face that is close to the main body 141.

In cases where a plurality of processing sections 142 are provided on the main body 141, it is preferable for the processing sections 142 to be equally spaced on the rotational path of the processing vane 140 from the perspective of stably operating the mixing process apparatus 2.

An explanation of the size of the processing vane 140 will now be given using FIGS. 9, 10A and 10B.

The length of the processing section 142 can be set within a range whereby the processing section 142 does not come into contact with the inner peripheral surface of the processing tank 110.

If half of the internal diameter of the processing tank 110 is denoted by d2 (mm) and the radius of the rotational path at the tip of the processing vane 140 that is most distant in the peripheral direction of the processing vane 140 is denoted by d1 (mm), it is preferable for d1 to be at least 80% and less than 100% of d2, that is, further outside than 0.8 L in FIG. 9. It is more preferable for d1 to be at least 90% of d2, that is, further outside than 0.9 L in FIG. 9, and further preferably at least 95% of d2.

Figure 10A:
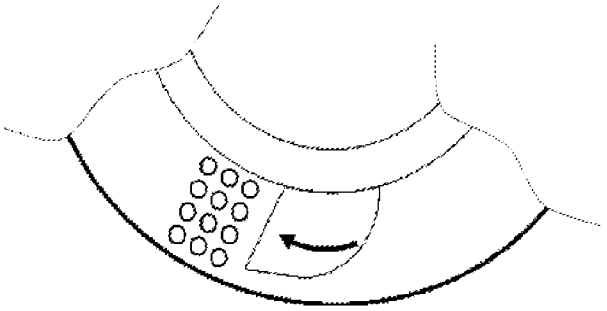
FIGS. 10A and 10B are diagrams that explains the size of a processing vane.

By configuring in this way, the processing face is long on the outside in the radial direction, as shown in FIG. 10A, and in cases where the height of the processing face is the same, the processing area increases, and it is therefore possible to process a large number of rotating processing subjects.

In addition, because the processing vane rotates, the peripheral speed is higher for those parts of the processing face that are distant from the drive shaft 111. As the peripheral speed increases, it is thought that the effect of causing the processing subject to adhere increases due to collisional forces on the processing subject increasing.

Figure 10B:
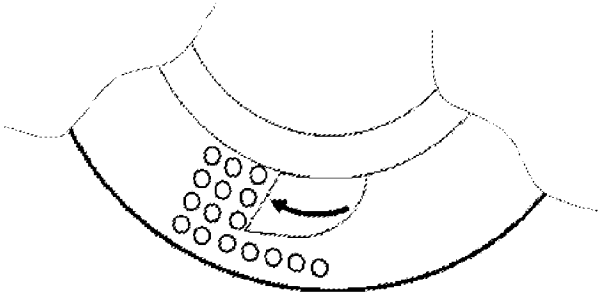

As shown in FIG. 10B, however, in cases where the length of the processing face is short, it is thought that the probability of collisions with the processing subject decreases. In addition, because the processing face is not present in a region, which is distant from the drive shaft 111 and has a high peripheral speed, as explained above, it is thought that the effect of processing the processing subject decreases.

The angle of the processing face relative to the rotation direction of the processing vane 140 will now be explained using FIGS. 11 and 12A to 12C.

Figure 11:
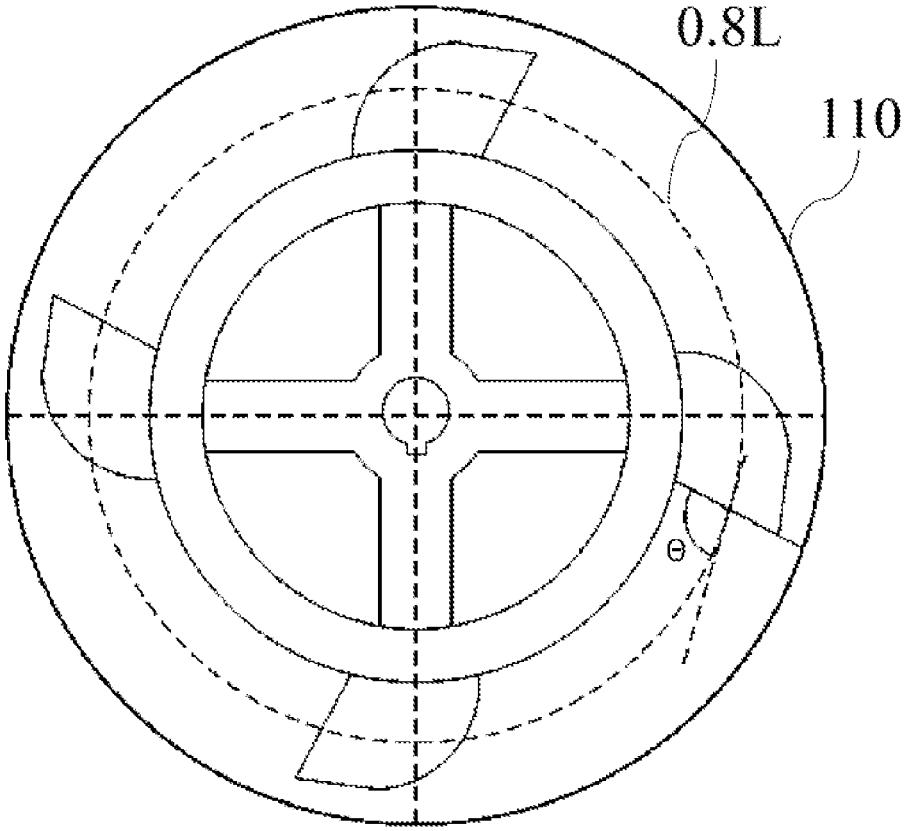
FIG. 11 is a diagram that explains the angle of a processing face relative to the rotation direction of a processing vane.

A path positioned at 80% of d2 from the drive shaft is shown by 0.8 L in FIG. 11.

Within the angle formed between a line connecting the closest point to the rotating member main body on the processing face and a point that intersects with 0.8 L in FIG. 11 and a tangent of the 0.8 L circle on the processing face in FIG. 11, the size (θ) of the angle on the downstream side in the direction of rotation is preferably 90° to 1300. An angle θ of 90° to 1300 is preferred from the perspective of lowering the adhesion index of the external additive B.

If the processing subject rotates in a circumferential direction that is concentric with the rotation of the processing vane, it is thought that the direction of flow of the processing subject is a tangential direction that is concentric with the rotation of the processing vane.

The angle at which the processing subject impacts on the processing face is thought to be the angle between the processing face and the tangential direction of a circle centered on the drive shaft and having a certain a radius.

As the processing subject rotates in the direction of rotation of the processing vane, it is thought that the processing subject becomes distant from the drive shaft side due to centrifugal force and flows in a direction towards the inner wall of the processing tank 110.

Figure 12A:
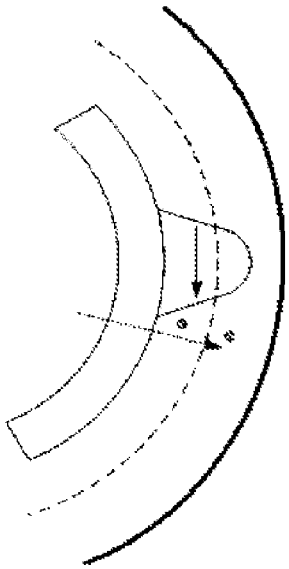
FIGS. 12A to 12C are diagrams that explains the angle of a processing face relative to the rotation direction of a processing vane.
Figure 12B:
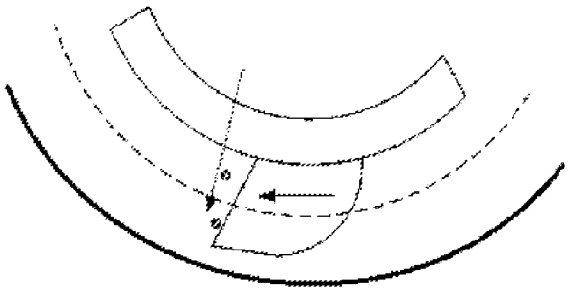

If the angle θ is at least 90°, as shown in FIG. 12B, it is thought that the processing subject (the particles shown in the drawing) flowing towards the inner wall of the processing tank 110 can effectively impact on the processing face.

In cases where the angle θ is less than 90°, as shown in FIG. 12A, the processing subject flowing towards the inner wall of the processing tank 110 are unlikely to effectively impact on the processing face, and the peripheral speed of the tip of the processing face increases, and this is particularly significant at the distal end side where the processing effect is high.

Figure 12C:
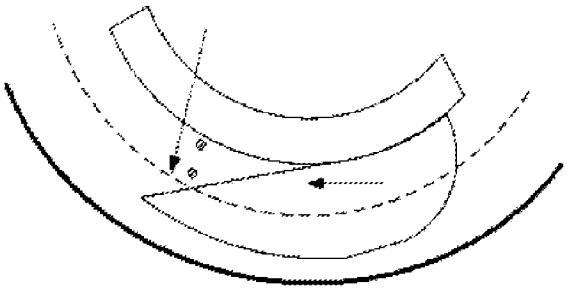

As shown in FIG. 12C, however, if the angle θ is not more than 130°, the processing subject readily impacts on the distal end side of the processing face, where the peripheral speed is high, and it is thought that the processing effect can therefore be increased.

The reason for this is not clear, but is surmised to be as follows.

If the angle θ is too great, the processing face is overly inclined to the inner surface side of the processing tank 110, meaning that flow of the processing subject flowing towards the inner wall of the processing tank 110 is impaired and distribution of the processing subject at the vicinity of the inner wall of the processing tank 110 may be reduced. However, if the angle θ is not more than 130°, flow impairment such as that mentioned above does not occur, distribution of the processing subject at the vicinity of the inner wall of the processing tank 110 increases, and it is thought that processing efficiently occurs at the distal end side of the processing face, where the peripheral speed is high.

Therefore, the adhesion index of the external additive can be readily lowered if the angle θ is 90° to 1300. The angle θ is preferably 90° to 1210°.

Furthermore, it is more preferable for the processing face to be configured so as to extend outwards in the radial direction in the form of a plane from the outer peripheral surface of the rotating member main body.

A perspective view of the processing face is shown in FIG. 8. This processing face is a rectangular plane and is parallel to the drive shaft 111.

If the processing face extends outwards in the radial direction in the form of a plane from the outer peripheral surface of the rotating member main body, it is thought that the processing face effectively impacts with the processing subject and processes such as adhesion and crushing readily progress.

Figure 13A:
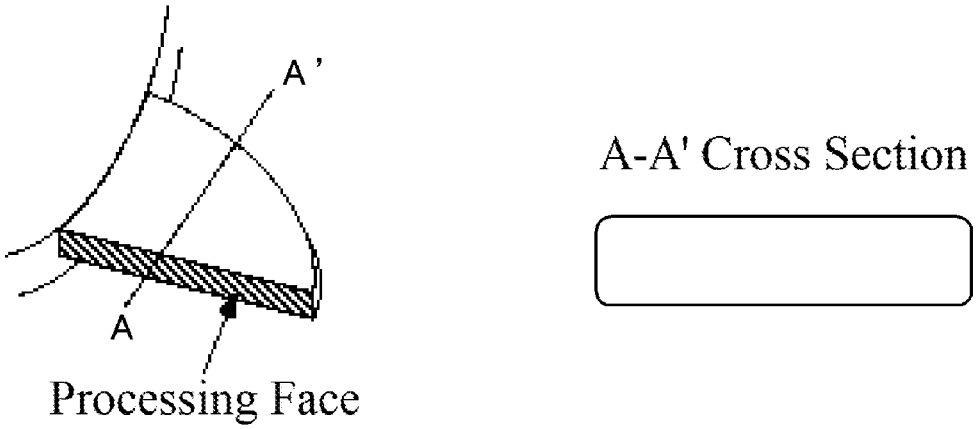
FIGS. 13A to 13E are diagrams that explains the configuration of a processing face.
Figure 13B:
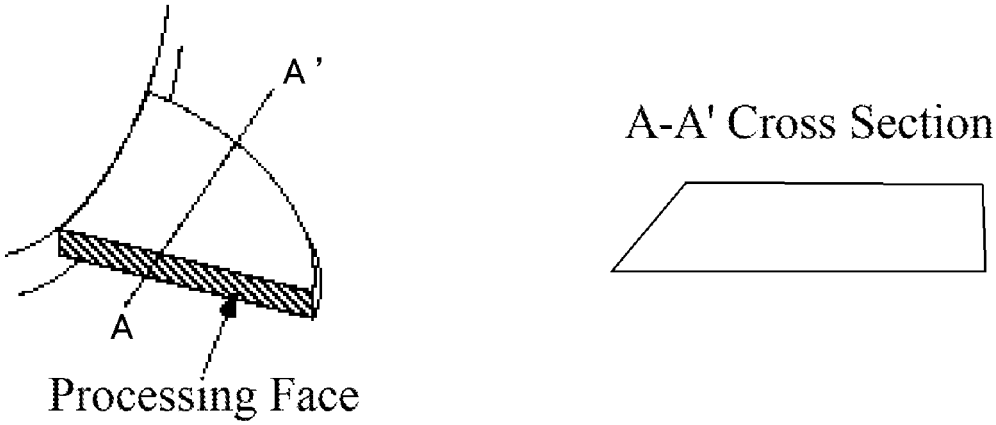
Figure 13C:
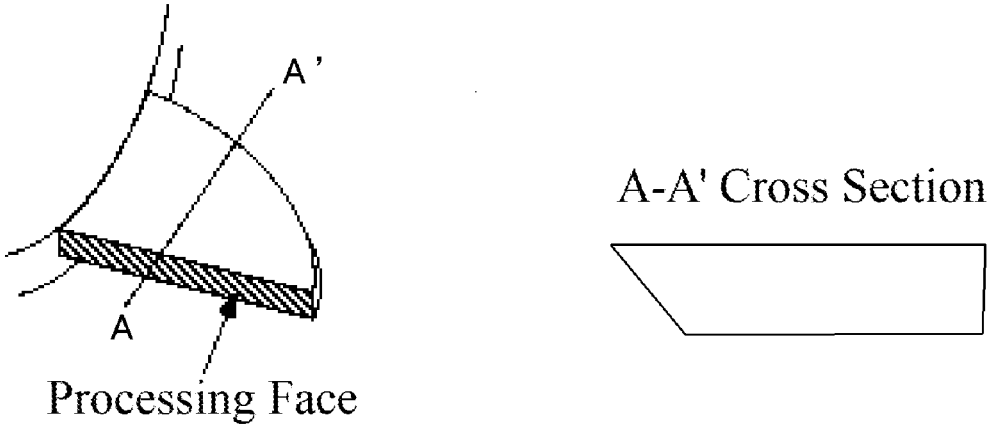
Figure 13D:
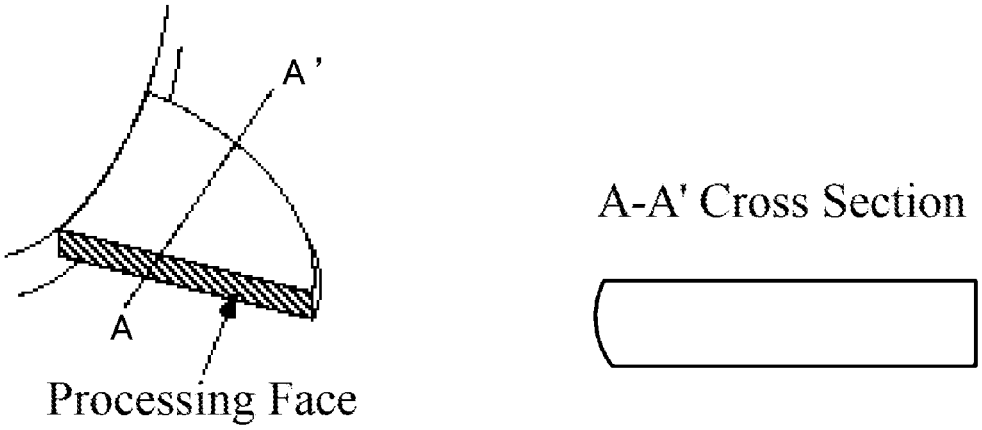
Figure 13E:
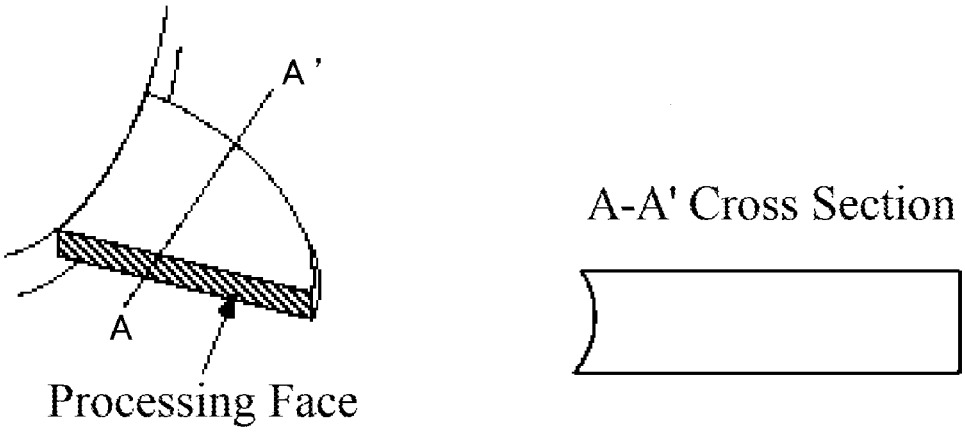

In addition to the configuration shown in FIG. 8, the processing face may have a configuration in which the upper and lower edges of the processing face are curved, as shown by the cross-sectional view A-A' in FIG. 13A, or a configuration in which the processing face forms an angle relative to the drive shaft 111, as shown in FIGS. 13B and 13C. In addition, the processing face may have a shape that is curved in the vertical direction, as shown in FIGS. 13D and 13E.

An explanation will now be given of the thickness of the processing section 142 in a direction parallel to the drive shaft 111.

As a result of investigations in which the thickness of the processing section 142 was altered, it was understood that as the thickness increases, impulsive forces and shearing forces increase, and processing is enhanced. In addition, as the thickness increases, the area of the processing face increases and the amount of heat generated by friction between the processing section and the processing subject increases. However, if the thickness is too great, the weight of the processing section 142 increases and, depending on the operating conditions of the apparatus, operation may become unstable and the load on the drive system may increase.

The results of the investigations have shown that the thickness of the processing section 142 is preferably 1% to 4% of the diameter of the processing tank 110.

From the perspective of being able to lower the adhesion index of the external additive B to the toner particle of the present invention, the maximum peripheral speed of the rotating member is preferably 20.0 to 70.0 m/sec, and more preferably 30.0 to 40.0 m/sec.

For similar reasons, the processing time is preferably adjusted within the range of 0.5 to 60.0 minutes, and more preferably 1.0 to 30.0 minutes.

In cases where external addition and heating are carried out in a single step using the mixing process apparatus 2, it is preferable to pass water having a prescribed temperature through the jacket (not shown) of the mixing process apparatus 2 and then carry out heating in order to lower the adhesion index of the external additive B. The temperature $T_R$ (° C.) during the heating is preferably such that Tg−10 (° C.)≤$T_R$≤Tg+5 (° C.) (where Tg (° C.) denotes the glass transition temperature of the toner particle), and more preferably such that Tg−5 (° C.)≤$T_R$≤Tg+5 (° C.).

In cases where the external additive B is adhered by means of heat in the external addition step, it is preferable to use a publicly known mixing machine such as a Super Mixer (available from Kawata Mfg. Co., Ltd.), a Nobilta (available from Hosokawa Micron Corporation) or a Hybridizer (available from Nara Machinery Co., Ltd.). Heating can be carried out by passing water having a prescribed temperature through a jacket in these machines.

The toner of the present invention is not limited in other ways as long as the toner has the characteristics mentioned above, but the toner more preferably has the configuration shown below.

The toner of the present invention is such that in scanning electron microscope observations of the toner surface, the surface abundance of the inorganic fine particles A, as obtained by image analysis of the toner surface at an accelerating voltage of 5.0 kV, is preferably 10% to 70%, and more preferably 20% to 65%.

If the surface abundance of the inorganic fine particles A falls within this range, it is easy to achieve a balance between a stress propagation effect caused by overlap with the external additive B and suppression of fixing impairment due to the filler effect during fixing. As a result, a decrease in image density caused by deterioration in durability is unlikely to occur while low-temperature fixability is ensured.

The number average particle diameter of primary particles of the inorganic fine particles A used in the toner of the present invention is preferably 50 to 500 nm, and more preferably 50 to 300 nm. However, the number average particle diameter of primary particles of the inorganic fine particles A must be greater than the number average particle diameter of primary particles of the external additive B. If the number average particle diameter of primary particles of the inorganic fine particles A falls within this range, the stress propagation effect caused by overlap with the external additive B can be easily achieved.

The inorganic fine particles A used in the present invention are present inside the surface of the toner particle, and are therefore preferably metal oxide particles from the perspective of maintaining charging performance. Specific examples thereof include iron oxide fine particles, silica fine particles, alumina fine particles, titania fine particles, zinc oxide fine particles, strontium titanate fine particles, cerium oxide fine particles and calcium carbonate fine particles. In addition, it is possible to use composite oxide fine particles obtained using two or more types of metal, and it is possible to use two or more types selected as arbitrary combinations from among these fine particle groups.

In the toner of the present invention, the coverage ratio of the toner particle surface by the external additive B is preferably 10% to 80%, and more preferably 10% to 60%. If the coverage ratio by the external additive B falls within this range, it is easy to achieve a balance between a stress propagation effect caused by overlap with the inorganic fine particles A and suppression of fixing impairment due to the filler effect during fixing. As a result, a decrease in image density caused by deterioration in durability is unlikely to occur while low-temperature fixability is ensured.

The coverage ratio of the toner particle surface by the external additive B can be adjusted, as appropriate, by altering the added quantity of the external additive B and the external addition conditions.

The dispersion evaluation index of the external additive B at the toner surface is preferably not more than 0.80, and more preferably not more than 0.50. The dispersion evaluation index is preferably at least 0.00. If the dispersion evaluation index falls within this range, this means that the external additive B present at the toner surface is uniformly dispersed. As a result, the charging distribution of the toner is sharp, which is effective for fogging in low temperature low humidity environments.

The dispersion evaluation index of the external additive B at the toner surface can be adjusted, as appropriate, by altering the added quantity of the external additive B, the external addition conditions and the shape factor SF-2.

The shape factor SF-2 of the external additive B is preferably 103 to 120, and more preferably 105 to 120. If the shape factor SF-2 of the external additive B falls within this range, the external additive B is unlikely to move on the toner particle, meaning that it is easy to adjust the value of Nb/Na within the prescribed range and the external additive is unlikely to migrate even if the external additive receives a large amount of load inside a developing device. As a result, a decrease in image density caused by deterioration in durability is unlikely to occur even in cases where images having a low print percentage are printed over a long period of time.

The shape factor SF-2 can be adjusted, as appropriate, by altering the production conditions of the external additive B.

Examples of the external additive B include metal oxide fine particles such as silica fine particles, alumina fine particles, titania fine particles, zinc oxide fine particles, strontium titanate fine particles, cerium oxide fine particles and calcium carbonate fine particles. In addition, it is possible to use composite oxide fine particles obtained using two or more types of metal, and it is possible to use two or more types selected as arbitrary combinations from among these fine particle groups.

In addition, it is possible to use resin fine particles and organic-inorganic composite fine particles comprising resin fine particles and inorganic fine particles.

More preferably, the external additive B has at least one selected from the group consisting of silica fine particles and organic-inorganic composite fine particles.

Examples of silica fine particles include sol gel silica fine particles produced using a sol gel method, aqueous colloidal silica fine particles, alcoholic silica fine particles, fumed silica fine particles obtained using a vapor phase method, and fused silica fine particles. The advantageous effect of the present invention can be readily achieved if the silica fine particles are aspherical.

Examples of resin fine particles include particles of resins such as vinyl-based resins, polyester resins and silicone resins.

Examples of organic-inorganic composite fine particles include organic-inorganic composite fine particles constituted from resin fine particles and inorganic fine particles.

Organic-inorganic composite fine particles maintain the good durability and charging performance of inorganic fine particles while being unlikely to impair coalescence of toner particles during fixing or impair fixing due to the presence of resin material components having low heat capacities. As a result, it is easy to achieve a balance between durability and fixing performance.

A preferred configuration of organic-inorganic composite fine particles is composite fine particles having protruded portions constituted from inorganic fine particles embedded in the surface of resin fine particles (and preferably vinyl-based resin fine particles) that are a resin component. A more preferred configuration is one in which inorganic fine particles are exposed at the surface of vinyl-based resin particles. An even more preferred configuration is one having protruded portions derived from the inorganic fine particles at the surface of the vinyl-based resin particles.

Examples of the inorganic fine particles that constitute the organic-inorganic composite fine particles include metal oxide fine particles such as silica fine particles, alumina fine particles, titania fine particles, zinc oxide fine particles, strontium titanate fine particles, cerium oxide fine particles and calcium carbonate fine particles.

The external additive B may be surface treated. A hydrophobic treatment agent or the like can be used as a surface treatment agent used for the surface treatment.

Specific examples of hydrophobic treatment agents include chlorosilanes such as methyltrichlorosilane, dimethyldichlorosilane, trimethylchlorosilane, phenyltrichlorosilane, diphenyldichlorosilane, t-butyldimethylchlorosilane and vinyltrichlorosilane;

alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-amioethyl)aminopropyltrimethoxysilane and γ-(2-aminoethyl) aminopropylmethyldimethoxysilane;

silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane and dimethyltetravinyldisilazane;

silicone oils such as dimethyl silicone oil, methylhydrogen silicone oil, methylphenyl silicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils, fluorine-modified silicone oils and terminal-reactive silicone oils;

siloxanes such as hexamethylcyclotrisiloxane, octamethylcyclotetrasiloxane, decamethylcyclopentasiloxane, hexamethyldisiloxane and octamethyltrisiloxane; and as fatty acids and metal salts thereof, long chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linolic acid and arachidonic acid, and salts of these fatty acids and metals such as zinc, iron, magnesium, aluminum, calcium, sodium and lithium.

Of these, alkoxysilanes, silazanes and silicone oils facilitate hydrophobic treatment, and can therefore be advantageously used. It is possible to use one of these hydrophobic treatment agents singly, or a combination of two or more types thereof.

The toner of the present invention may contain external additives other than external additive B in order to improve the flowability and charging performance of the toner.

The toner of the present invention is preferably such that in a nanoindentation method, if the toner hardness A (N/m) is defined as the average inclination in a displacement region of 0.0 to 0.20 μm when a load-displacement curve measured at a load application speed of 0.83 μN/sec has a load a (mN) as the vertical axis and a displacement amount b (μm) as the horizontal axis, and the toner hardness B (N/m) is defined as the average inclination in a displacement region of 0.0 to 0.20 μm when a load-displacement curve measured at a load application speed of 2.50 μN/sec has a load a (mN) as the vertical axis and a displacement amount b (μm) as the horizontal axis, formula (1) and formula (2) below are satisfied.

$$B \geq 600 \quad (1)$$

$$B/A \geq 1.05 \quad (2)$$

The toner hardness B is more preferably at least 900 N/m. In addition, the value of B/A is more preferably at least 1.08.

The toner hardness B is more preferably not more than 1,200 N/m. In addition, the value of B/A is more preferably not more than 1.30.

The inventors of the present invention considered evaluating toner hardness A in a nanoindentation method as the hardness of a toner surface layer against low frequency impulsive forces and evaluating toner hardness B as the hardness of a toner surface layer against high frequency impulsive forces. That is, it is thought that the hardness of a toner surface layer against high frequency impulsive forces is an evaluation indicator of durability against situations in which strong forces are encountered for a short period of time, such as in a developing device, and that the hardness of a toner surface layer against low frequency impulsive forces is an evaluation indicator of the ease with which a toner deforms in a pressure-free situation.

Therefore, by satisfying the ranges of formula (1) and formula (2) in a nanoindentation method, it is thought that a toner surface layer hardening effect can be achieved as a result of a stress propagation effect, and a decrease in image density caused by deterioration in durability is unlikely to occur while low-temperature fixability is ensured.

Toner hardness A and B can be adjusted, as appropriate, by altering the type and added quantity of the inorganic fine particles A, the Tg value of the toner and toner production conditions.

The toner of the present invention is such that in a cross-sectional observation of the toner using a transmission electron microscope (TEM), if X (nm) denotes the maximum diameter of primary particles of the external additive B and Y (nm) denotes the maximum embedded length of the external additive B embedded in the surface of the toner particle, formula (3) below is satisfied.

$$0.15 \leq Y/X \quad (3)$$

The standard deviation of Y/X is preferably not more than 20%.

The value of Y/X more preferably falls within the range 0.15 to 0.35.

The standard deviation of Y/X is more preferably not more than 18%. The standard deviation of Y/X is more preferably not more than 16%.

Here, the maximum embedded length Y (nm) of the external additive B means the maximum length of a portion where the external additive B is embedded in the toner particle in a normal direction relative to a line that connects both ends of an interface between the surface of the toner particle and the external additive B.

Figure 14A:
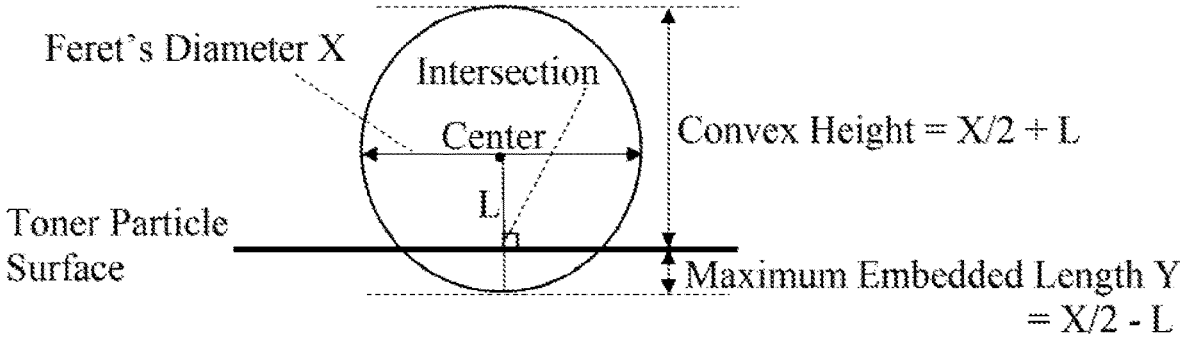
FIGS. 14A to 14B are images of a toner cross section.
Figure 14B:
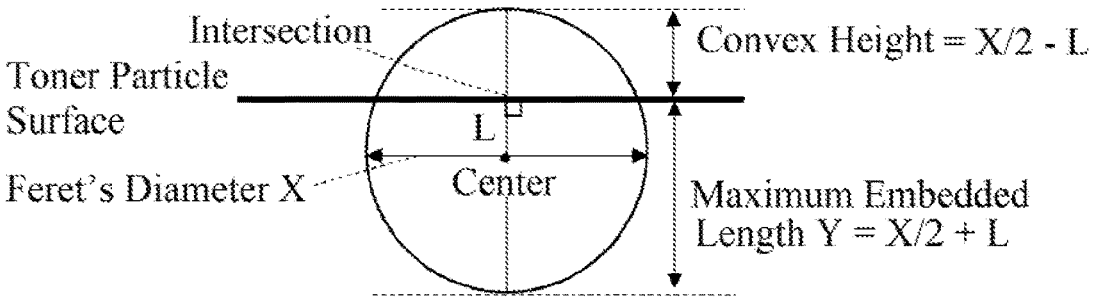

Specifically, a cross-sectional photograph of the toner, including the external additive B, is obtained using a transmission electron microscope (TEM). FIGS. 14A and 14B show images of a toner cross section. In the cross-section image, the maximum diameter (Feret's diameter) of the external additive B is denoted by X (nm), and the maximum length of a portion where the external additive B is embedded in the toner particle in a normal direction relative to a line that connects both ends of an interface between the surface of the toner particle and the external additive B is denoted by Y (nm).

As the ratio of the maximum embedded length Y relative to the maximum diameter X of the external additive B increases, the external additive B becomes more embedded. In the present invention, the ratio (Y/X) of the maximum embedded length Y relative to the maximum diameter (Feret's diameter) X of the external additive B is used as an indicator of the degree of embedding of the external additive B. That is, as the value of Y/X increases, the external additive B becomes more deeply embedded in the toner particle.

In the present invention, if the value of Y/X is at least 0.15 and the standard deviation thereof is not more than 20%, it is possible to achieve an improvement in transferability from a photosensitive drum to a paper. This effect can be achieved particularly well for transferability to extremely rough paper.

The maximum embedded length Y can be adjusted, as appropriate, by altering the type, added quantity, shape and external addition conditions of the external additive B.

More detailed explanations will now be given of preferred aspects of the present invention.

Examples of binder resins used in the toner particle include those listed below.

Vinyl-based resins, styrene-based resins, styrene-based copolymer resins, polyester resins, polyol resins, poly(vinyl chloride) resins, phenol resins, natural resin-modified phenol resins, natural resin-modified maleic resins, acrylic resins, (meth)acrylic resins, poly(vinyl acetate) resins, silicone resins, polyurethane resins, polyamide resins, furan resins, epoxy resins, xylene resins, poly(vinyl butyral) resins, terpene resins, coumarone-indene resins and petroleum-based resins. It is possible to use one of these resins singly, or a combination of two or more types thereof.

Preferred resins are styrene-based copolymer resins, polyester resins, mixtures of polyester resins and vinyl-based resins, and hybrid resins in which polyester resins and vinyl-based resins are partially reacted.

The toner particle may contain a release agent.

Examples of release agents include waxes containing mainly fatty acid esters, such as carnauba wax and montanic acid ester waxes; waxes obtained by partially or completely deoxidizing fatty acid esters, such as deoxidized carnauba wax; hydroxyl group-containing methyl ester compounds obtained by hydrogenation or the like of vegetable oils; saturated fatty acid monoesters such as stearyl stearate and behenyl behenate; diesters of saturated aliphatic dicarboxylic acids and saturated aliphatic alcohols, such as dibehenyl sebacate, distearyl dodecanedicarboxylate and distearyl octadecanedicarboxylate; diesters of saturated aliphatic diols and saturated fatty acids, such as nonane diol dibehenate and dodecane diol distearate; aliphatic hydrocarbon-based waxes such as low molecular weight polyethylene, low molecular weight polypropylene, microcrystalline waxes, paraffin waxes and Fischer Tropsch waxes; oxides and block copolymers of aliphatic hydrocarbon-based waxes such as oxidized polyethylene waxes; waxes obtained by grafting vinyl-based monomers, such as styrene and acrylic acid, onto aliphatic hydrocarbon waxes; saturated straight chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; polyvalent alcohols such as sorbitol; fatty acid amides such as linolic acid amide, oleic acid amide and lauric acid amide; saturated fatty acid bisamides such as methylene-bisstearic acid amide, ethylene-biscapric acid amide, ethylene-bislauric acid amide and hexamethylene-bisstearic acid amide; unsaturated fatty acid amides such as ethylene-bisoleic acid amide, hexamethylene-bisoleic acid amide, N,N'-dioleyladipic acid amide and N,N'-dioleylsebacic acid amide; aromatic bisamides such as m-xylene-bisstearic acid amide and N,N'-distearylisophthalic acid amide; fatty acid metal salts such as calcium stearate, calcium laurate, zinc stearate and magnesium stearate (these are generally known as metal soaps); and long chain alkyl alcohols and long chain alkyl carboxylic acids having at least 12 carbon atoms. It is possible to use one of these release agents singly, or a combination of two or more types thereof.

Of these release agents, monofunctional and difunctional ester waxes, such as saturated fatty acid monoesters and diesters, and hydrocarbon waxes, such as paraffin waxes and Fischer Tropsch waxes, are preferred.

In addition, the melting point of the release agent is preferably 60° C. to 140° C., and more preferably 60° C. to 90° C. If the melting point is at least 60° C., the storability of the toner improves. Meanwhile, if the melting point is not more than 140° C., low-temperature fixability tends to improve. The melting point of the release agent is defined as the peak temperature of the maximum endothermic peak during heating, as measured using a differential scanning calorimeter (DSC).

The content of the release agent is preferably 3 to 40 parts by mass relative to 100 parts by mass of the binder resin.

The toner particle preferably contains a charge control agent.

Organometallic complex compounds and chelate compounds are effective as charge control agents for negative charging, and examples thereof include monoazo metal complexes; acetylacetone metal complexes; and metal complex compounds of aromatic hydroxycarboxylic acids and aromatic dicarboxylic acids.

Specific examples of commercially available products include Spilon Black TRH, T-77 and T-95 (available from Hodogaya Chemical Co., Ltd.) and BONTRON (registered trademark)S-34, S-44, S-54, E-84, E-88 and E-89 (available from Orient Chemical Industries Co., Ltd.).

It is possible to use one of these charge control agents singly, or a combination of two or more types thereof.

From the perspective of the charge quantity of the toner, the usage quantity of these charge control agents is preferably 0.1 to 10.0 parts by mass, and more preferably 0.1 to 5.0 parts by mass, relative to 100 parts by mass of the binder resin.

The toner of the present invention can be used as a magnetic one-component toner, a non-magnetic one-component toner or a non-magnetic two-component toner.

In cases where the toner is used as a magnetic one-component toner, a magnetic body can be advantageously used as a colorant. Examples of the magnetic body contained in the magnetic one-component toner include magnetic iron oxides, such as magnetite, maghemite and ferrite; magnetic iron oxides including other metal oxides; metals such as Fe, Co and Ni; alloys of these metals and metals such as Al, Co, Cu, Pb, Mg, Ni, Sn, Zn, Sb, Be, Bi, Cd, Ca, Mn, Se, Ti, W and V, and mixtures of these. In cases where the toner particle contains a magnetic body, it is possible to impart the magnetic body with the function of the inorganic fine particles A. The inorganic fine particles A may be magnetic bodies or contain magnetic bodies.

Of these, magnetite can be advantageously used, and the shape thereof can be polyhedral, octahedral, hexahedral, spherical, acicular or flaky, but shapes having low anisotropy, such as polyhedral, octahedral, hexahedral and spherical, are preferred from the perspective of increasing image density.

The number average particle diameter of the magnetic body is preferably 0.10 to 0.40 μm. If the number average particle diameter of the magnetic body is at least 0.10 μm, magnetic bodies are unlikely to aggregate and uniform dispersibility of magnetic bodies in the toner is improved. In addition, if the number average particle diameter of the magnetic body is not more than 0.40 μm, the tinting strength of the toner improves, which is desirable.

The magnetic body can be produced using, for example, the method described below.

An aqueous solution containing ferrous hydroxide is prepared by adding, to an aqueous solution of a ferrous salt, an alkali such as sodium hydroxide at an equivalent or higher quantity relative to the content of iron. While maintaining the pH of the prepared aqueous solution at at least 7, air is blown into the aqueous solution, an oxidation reaction of the ferrous hydroxide is carried out while the temperature of the aqueous solution is increased to at least 70° C., and a seed crystal that serves as the core of the magnetic body is produced.

Next, an aqueous solution containing ferrous sulfate is added at a quantity of 1 equivalent relative to the added quantity of alkali previously added to the slurry-like liquid containing the seed crystal. While maintaining the pH of the liquid at 5 to 10 and blowing air, a reaction of the ferrous hydroxide progresses, the seed crystal forms a core, and a magnetic iron oxide powder is grown. Here, by selecting the pH, reaction temperature and stirring conditions as appropriate, it is possible to control the shape and magnetic properties of the magnetic body. As the oxidation reaction progresses, the pH of the liquid becomes acidic, but it is preferable for the pH of the liquid not to go lower than 5. It is possible to obtain a magnetic body by filtering, washing and drying the thus obtained magnetic iron oxide particles using conventional methods.

In addition, in cases where the toner particle is produced using a polymerization method, it is preferable to subject the surface of the magnetic body to a hydrophobic treatment. In cases where a surface treatment is carried out using a dry method, it is possible to treat the surface of the washed, filtered and dried magnetic body with a coupling agent. In cases where a surface treatment is carried out using a wet method, it is possible to carry out a coupling treatment following completion of the oxidation reaction and redispersing the dried product or, following completion of the oxidation reaction, washing, filtering so as to obtain an iron oxide and then redispersing the iron oxide in another aqueous medium without drying the iron oxide.

Specifically, it is possible to carry out a coupling treatment by adding a silane coupling agent while thoroughly stirring the redispersed solution and then increasing the temperature following hydrolysis, or by adjusting the pH of the dispersed solution to the alkaline side following hydrolysis. Of these, it is preferable to carry out a surface treatment following completion of the oxidation reaction by filtering and washing and then forming a slurry without drying from the perspective of carrying out a uniform surface treatment.

In order to surface treat the magnetic body using a wet method, that is, in order to treat with a coupling agent in an aqueous medium, the magnetic body is first sufficiently dispersed in the aqueous medium so as to attain a primary particle diameter, and then stirring with a stirring vane or the like so that sedimentation and aggregation do not occur. Next, an arbitrary quantity of a coupling agent is introduced into the dispersed solution and a surface treatment is carried out while hydrolyzing the coupling agent, but in this case also, it is more preferable to carry out the surface treatment by stirring while sufficiently dispersing the solution with an apparatus such as a pin mill or line mill so as to prevent aggregation.

Here, the aqueous medium is a medium in which water is the primary component. Specific examples thereof include water per se, media obtained by adding a small quantity of a surfactant to water, media obtained by adding a pH adjusting agent to water and media obtained by adding an organic solvent to water. A non-ionic surfactant such as poly(vinyl alcohol) is preferred as the surfactant. The surfactant is preferably added at a quantity of 0.1 mass % to 5.0 mass % in the aqueous medium. Inorganic acids such as hydrochloric acid can be given as examples of pH adjusting agents. Alcohols can be given as examples of organic solvents.

Examples of coupling agents able to be used in the surface treatment of the magnetic body include silane coupling agents and titanium coupling agents. More preferred coupling agents are silane coupling agents that are represented by general formula (I).

$$R_mSiY_n \quad (I)$$

Where, R denotes an alkoxy group (preferably having 1 to 3 carbon atoms), m denotes an integer of 1 to 3, Y denotes a functional group such as an alkyl group (preferably having 2 to 20 carbon atoms), a phenyl group, a vinyl group, an epoxy group, an acrylic group or a methacrylic group, and n denotes an integer of 1 to 3. However, m+n=4.

Examples of silane coupling agents represented by general formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, alkyltrialkoxysilane coupling agents represented by general formula (II) are preferably used from the perspective of imparting the magnetic body with high hydrophobicity.

$$C_pH_{2p+1}—Si—(OC_qH_{2q+1})_3 \quad (II)$$

Where, p denotes an integer of 2 to 20, and q denotes an integer of 1 to 3.

If p is at least 2 in the formula above, it is possible to impart the magnetic body with sufficient hydrophobicity. If p is not more than 20, hydrophobicity is sufficient and it is possible to suppress coalescence between magnetic bodies. Furthermore, if q is not more than 3, the reactivity of the silane coupling agent is good and hydrophobization tends to be sufficient.

Therefore, it is preferable to use an alkyltrialkoxysilane coupling agent in which p in the formula is an integer of 2 to 20 (and more preferably an integer of 3 to 15) and q is an integer of 1 to 3 (and more preferably 1 or 2).

In cases where a silane coupling agent mentioned above is used, the treatment can be carried out using one silane coupling agent singly or a combination of multiple silane coupling agents. In cases where a combination of multiple silane coupling agents is used, it is possible to carry out separate treatments using individual coupling agents or use the coupling agents simultaneously.

The total treatment amount of the coupling agents used is preferably 0.9 to 3.0 parts by mass relative to 100 parts by mass of the magnetic body, and it is preferable to adjust the amount of treatment agent according to the surface area of the magnetic body, the reactivity of the coupling agent(s), and the like.

In addition to the magnetic body it is possible to use other colorants in the toner particle.

The colorants listed below can be given as examples of colorants in cases where the toner is used as a non-magnetic one-component toner or a non-magnetic two-component toner.

Carbon black such as furnace black, channel black, acetylene black, thermal black and lamp black can be used as black pigments, and magnetic powders such as magnetite and ferrite can also be used.

Pigments and dyes can be used as suitable colorants for a yellow color. Examples of pigments include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191; and C. I. Vat Yellow 1, 3 and 20. Examples of dyes include C. I. Solvent Yellow 19, 44, 77, 79, 81, 82, 93, 98, 103, 104, 112 and 162. It is possible to use one of these colorants singly, or a combination of two or more types thereof.

Pigments and dyes can be used as suitable colorants for a cyan color. Examples of pigments include C. I. Pigment Blue 1, 7, 15, 15:1, 15:2, 15:3, 15:4, 16, 17, 60, 62 and 66, C. I. Vat Blue 6 and C. I. Acid Blue 45. Examples of dyes include C. I. Solvent Blue 25, 36, 60, 70, 93 and 95. It is possible to use one of these colorants singly, or a combination of two or more types thereof.

Pigments and dyes can be used as suitable colorants for a magenta color. Examples of pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48;2, 48;3, 48;4, 49, 50, 51, 52, 53, 54, 55, 57, 57;1, 58, 60, 63, 64, 68, 81, 81;1, 83, 87, 88, 89, 90, 112, 114, 122, 123, 144, 146, 150, 163, 166, 169, 177, 184, 185, 202, 206, 207, 209, 220, 221, 238 and 254, C. I. Pigment Violet 19 and C. I. Vat Red 1, 2, 10, 13, 15, 23, 29 and 35.

Examples of magenta dyes include oil-soluble dyes such as C. I. Solvent Red 1, 3, 8, 23, 24, 25, 27, 30, 49, 52, 58, 63, 81, 82, 83, 84, 100, 109, 111, 121 and 122, C. I. Disperse Red 9, C. I. Solvent Violet 8, 13, 14, 21 and 27 and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27 and 28. It is possible to use one of these colorants singly, or a combination of two or more types thereof.

An example of a method for producing a toner will now be given, but the present invention is not limited to this example.

There are no limits on a production method for obtaining a surface abundance of inorganic fine particles A of 10% to 70%, but it is preferable to produce a toner particle in an aqueous medium using a dispersion polymerization method, an association aggregation method, a dissolution suspension method, a suspension polymerization method, and emulsion polymerization method, or the like. Of these, a suspension polymerization method is more preferred from the perspectives of facilitating the presence of the inorganic fine particles A inside the surface of the toner particle and enabling a toner having optimal physical properties to be obtained.

In a suspension polymerization method, a polymerizable monomer composition is first obtained by homogeneously dispersing the inorganic fine particles A and a colorant (and, if necessary, a polymerization initiator, a crosslinking agent, a charge control agent and other additives) in a polymerizable monomer able to form a binder resin. A toner particle having a desired particle diameter is then obtained by dispersing and granulating the obtained polymerizable monomer composition in a continuous phase (for example, an aqueous phase) containing a dispersion stabilizer using an appropriate stirring device, and carrying out a polymerization reaction using a polymerization initiator.

The toner and toner particle obtained using this suspension polymerization method are hereinafter referred to as a "polymerized toner" and "polymerized toner particle" respectively.

Examples of the polymerizable monomer include the types listed below.

Styrene-based monomers such as styrene, o-methylstyrene, m-methylstyrene, p-methylstyrene, p-methoxystyrene and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide. It is possible to use one of these monomers singly or a mixture thereof.

Of the monomers listed above, use of a styrene-based monomer singly or a mixture of a styrene-based monomer and another monomer such as an acrylic acid ester or methacrylic acid ester is preferred from the perspectives of controlling the structure of the toner particle and facilitating an improvement in the developing characteristics and durability of the toner. In particular, use of styrene and an alkyl acrylate ester or styrene and an alkyl methacrylate ester as primary components is more preferred. That is, it is preferable for the binder resin to be a styrene-acrylic resin.

The polymerization initiator used to produce the toner particle by means of a polymerization method is preferably one for which the half life in the polymerization reaction is 0.5 to 30 hours. In addition, it is preferable to use the polymerization initiator at an added quantity of 0.5 to 20 parts by mass relative to 100 parts by mass of the polymerizable monomer. In this way, it is possible to obtain a polymer having a maximum molecular weight within the range 5,000 to 50,000 and possible to achieve a strength that is preferable for the toner and appropriate melting properties.

Specific examples of polymerization initiators include azo-based and diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide-based polymerization initiators such as benzoyl peroxide, methyl ethyl ketone peroxide, diisopropylperoxy carbonate, cumene hydroperoxide, 2,4-dichlorobenzoyl peroxide, lauroyl peroxide, t-butylperoxy 2-ethylhexanoate, t-butylperoxy pivalate, di(2-ethylhexyl)peroxy dicarbonate and di(sec-butyl)peroxy dicarbonate.

Of these, t-butylperoxy pivalate is preferred.

In cases where the toner particle is produced using a polymerization method, a crosslinking agent may be added, and a preferred added quantity of the crosslinking agent is 0.001 to 15 parts by mass relative to 100 parts by mass of the polymerizable monomer.

Here, compounds having at least two polymerizable double bonds are mainly used as crosslinking agents, with examples thereof including aromatic divinyl compounds such as divinylbenzene and divinylnaphthalene; carboxylic acid esters having two double bonds, such as ethylene glycol diacrylate, ethylene glycol dimethacrylate and 1,3-butane diol dimethacrylate; divinyl compounds such as divinylaniline, divinyl ether, divinyl sulfide and divinyl sulfone; and compounds having at least three vinyl groups, and it is possible to use one of these compounds singly, or a mixture of two or more types thereof.

It is preferable to incorporate a polar resin in the polymerizable monomer composition. By incorporating a polar resin in order to produce the toner particle in an aqueous medium in a suspension polymerization method, it is possible to form a layer of the polar resin on the surface of the toner particle and possible to obtain a toner particle having a core/shell structure.

By having a core/shell structure, the degree of freedom of design for the core and shell increases. For example, by increasing the glass transition temperature of the shell, it becomes possible to suppress deterioration in durability (deterioration over long term use) such as embedding of the external additive. In addition, imparting the shell with a shielding effect facilitates uniformity of the shell composition and enables uniform charging.

Examples of polar resins for a shell layer include homopolymers of styrene and substituted products thereof, such as polystyrene and polyvinyltoluene; styrene-based copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleic acid ester copolymers; poly(methyl methacrylate), poly(butyl methacrylate), poly (vinyl acetate), polyethylene, polypropylene, poly(vinyl butyral), silicone resins, polyester resins, styrene-polyester copolymers, poly acrylate-polyester copolymers, polymethacrylate-polyester copolymers, polyamide resins, epoxy resins, poly(acrylic acid) resins, terpene resins and phenolic resins.

It is possible to use one of these polar resins singly or a combination of two or more types thereof. In addition, functional groups such as amino groups, carboxyl groups, hydroxyl groups, sulfone groups, glycidyl groups and nitrile groups may be introduced into these polymers. Of these resins, polyester resins are preferred.

Saturated polyester resins and/or unsaturated polyester resins can be selected and used, as appropriate, as polyester resins.

Ordinary polyester resins constituted from an alcohol component and an acid component can be used, and the examples given below can be used as these components.

Examples of divalent alcohol components include ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, cyclohexane dimethanol, butene diol, octene diol, cyclohexene dimethanol, hydrogenated bisphenol A, bisphenol derivatives represented by formula (A), hydrogenated products of compounds represented by formula (A), diols represented by formula (B), and diols of hydrogenated products of compounds represented by formula (B).

(A)

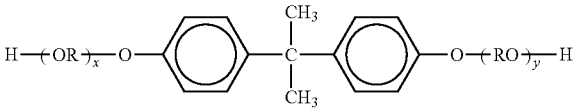

Where, R is an ethylene or propylene group, x and y are each an integer of 1 or greater, and the average value of x+y is 2 to 10.

(B)

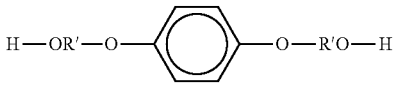

Where, R' denotes

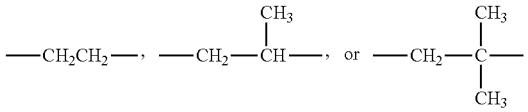

Alkylene oxide adducts of bisphenol A are particularly preferred as divalent alcohol components from the perspectives of excellent charging characteristics and environmental stability and achieving a balance with other electrophotography characteristics. In the case of such compounds the average number of added moles of alkylene oxide is preferably 2 to 10 from the perspective of fixing performance and toner durability.

Examples of divalent acid components include benzene dicarboxylic acids and anhydrides thereof, such as phthalic acid, terephthalic acid, isophthalic acid and phthalic acid anhydride; alkyl dicarboxylic acids and anhydrides thereof, such as succinic acid, adipic acid, sebacic acid and azelaic acid; succinic acid substituted with alkyl groups or alkenyl groups having 6 to 18 carbon atoms, and anhydrides thereof; and unsaturated dicarboxylic acids, such as fumaric acid, maleic acid, citraconic acid and itaconic acid, and anhydrides thereof.

For example, examples of trivalent or higher alcohol components include glycerin, pentaerythritol, sorbitol, sorbitan and oxyalkylene ethers of novolac type phenolic resins, and examples of trivalent or higher acid components include trimellitic acid, pyromellitic acid, 1,2,3,4-butanetetracarboxylic acid, benzophenonetetracarboxylic acid and anhydrides thereof.

The polyester resin is preferably a polycondensate of an alcohol component and a carboxylic acid component in which the content of straight chain aliphatic dicarboxylic acids having 6 to 12 carbon atoms is 10 to 50 mol % relative to all carboxylic acid components.

Such a polyester resin preferably has a carboxylic acid component in which the content of straight chain aliphatic dicarboxylic acids having 6 to 12 carbon atoms is 10 to 50 mol % relative to all carboxylic acid components. Because the softening point of a polyester resin tends to decrease in a state whereby the peak molecular weight of the polyester resin is increased, it is possible to increase toner strength while maintaining fixing performance.

In the polyester resin, if the total amount of the alcohol component and the acid component is taken to be 100 mol %, the content of the alcohol component is preferably 45 to 55 mol %.

The polyester resin can be produced using a catalyst such as a tin-based catalyst, an antimony-based catalyst or a titanium-based catalyst, but use of a titanium-based catalyst is preferred.

In addition, the polar resin for a shell layer preferably has a number average molecular weight of 2,500 to 25,000 from the perspectives of developing performance, blocking resistance and durability. Moreover, number average molecular weight can be measured by means of GPC.

The polar resin for a shell layer preferably has an acid value of 1.0 to 15.0 mgKOH/g, and more preferably 2.0 to 10.0 mgKOH/g. Controlling the acid value within the range mentioned above facilitates formation of a uniform shell.

The polar resin for a shell layer is preferably contained at a quantity of 2 to 20 parts by mass relative to 100 parts by mass of the binder resin from the perspective of sufficiently exhibiting the advantageous effect achieved by the shell layer.

The aqueous medium in which the polymerizable monomer composition is dispersed contains a dispersion stabilizer, but publicly known surfactants, organic dispersing agents and inorganic dispersing agents can be used as the dispersion stabilizer. Of these, inorganic dispersing agents achieve dispersion stability through steric hindrance, and can therefore be advantageously used from the perspectives of stability being unlikely to deteriorate even if the reaction temperature changes, being easily cleaned, and being unlikely to have an adverse effect on the toner.

Examples of such inorganic dispersing agents include polyvalent metal salts of phosphoric acid, such as tricalcium phosphate, magnesium phosphate, aluminum phosphate, zinc phosphate and hydroxyapatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

These inorganic dispersing agents are preferably used at a quantity of 0.2 to 20 parts by mass relative to 100 parts by mass of polymerizable monomer. In addition, it is possible to use one of these dispersion stabilizers singly, or a combination of multiple types thereof. Furthermore, a surfactant may additionally be used at a quantity of 0.001 to 0.1 parts by mass. If used, these inorganic dispersing agents may be used as-is, but in order to obtain finer particles, particles of the inorganic dispersing agents can be generated in an aqueous medium.

For example, in cases where the inorganic dispersing agent is tricalcium phosphate, by mixing an aqueous solution of sodium phosphate and an aqueous solution of calcium chloride under high speed stirring, it is possible to generate water-insoluble calcium phosphate and achieve finer and more uniform dispersion. Here, water-soluble sodium chloride is generated as a by-product at the same time, but the presence of a water-soluble salt in the aqueous medium is preferable from the perspectives of suppressing dissolution of the polymerizable monomer in water and the unlikelihood of an ultrafine toner being produced by emulsion polymerization.

Examples of surfactants include sodium dodecylbenzene sulfate, sodium tetradecyl sulfate, sodium pentadecyl sulfate, sodium octyl sulfate, sodium oleate, sodium laurate, sodium stearate and potassium stearate.

In the step for polymerizing the polymerizable monomer, the polymerization temperature is generally set to be at least 40° C., and preferably 50° C. to 90° C. By carrying out polymerization within this temperature range, the release agent to be internally sealed is precipitated due to phase separation and is more completely encapsulated.

Next, a cooling step is carried out for cooling from the reaction temperature of approximately 50° C. to 90° C. and completing the polymerization reaction step. During this process, it is preferably to cool gradually so as to maintain a state in which the release agent and the binder resin are compatibilized.

Following completion of polymerization of the polymerizable monomer, a toner particle is obtained by filtering, washing and drying the obtained polymer particles using publicly known methods. A toner can be obtained by mixing an external additive with this toner particle in the manner described above so as to cause the external additive to adhere to the surface of the toner particle. In addition, it is possible to incorporate a classification step in the production process and remove coarse particles and fine powder contained among the toner particles.

Explanations will now be given of methods for measuring a variety of physical properties of the toner of the present invention.

<Method for Measuring Number Average Particle Diameter of Primary Particles of External Additive B>

In cases where the number average particle diameter of the external additive B is measured using the toner to which the external additive B has been externally added, measurements are carried out using the following procedure. Moreover, in cases where the external additive B can be obtained in isolation, it is possible to measure the number average particle diameter of the external additive B in isolation using the following procedure.

Measurement of True Density of External Additive B

First, the true density of the external additive B is measured. 10 g of toner is suspended in 200 mL of methanol, an ultrasonic wave treatment is carried out for 30 minutes using an SC-103 ultrasonic disperser (available from SMT Corporation), and the external additive B is separated from the toner particle and left to stand for 24 hours. The sedimented toner particles and the external additive B dispersed in the supernatant liquid are separated, recovered and dried for 24 hours at 50° C. so as to isolate the external additive B.

The true density of the thoroughly dried external additive B is measured using an AccuPyc 1330 dry automatic density measuring apparatus available from Shimadzu Corporation. Conditions are as follows.

Cell: 1 mL

Sample amount: Such that the powder surface is at 80% of the height of the cell.

Measurement of Particle Size Distribution of External Additive B

The particle size distribution of the external additive is measured using a DC24000 disk centrifuging type particle size distribution measurement apparatus available from CPS Instruments, Inc. The measurement method is as follows.

First, a dispersion medium is prepared by placing 0.50 g of Triton-X100 (available from Kishida Chemical Co., Ltd.) in 100 g of ion exchanged water. The external additive B is separated from 1 g of the toner using the same procedure as that used in the true density measurements. The separated external additive B is transferred to a vial, and the dispersion medium is added so as to obtain a total mass of 10.00 g. Next, a dispersed solution is prepared by treating for 30 minutes with an ultrasonic wave type homogenizer.

Ultrasonic wave treatment apparatus: VP-050 ultrasonic wave type homogenizer (available from Taitec Corporation)
Microchip: Step type microchip, tip diameter φ 2 mm
Position of microchip tip: At the center of a glass vial, at a height of 5 mm from the bottom of the vial
Ultrasonic wave conditions: Intensity 30%, 30 minutes; here, irradiation with ultrasonic waves is carried out while cooling the vial with ice water so that the temperature of the dispersed solution does not increase.

Next, a dedicated syringe needle for the measurement apparatus (available from CPS Instruments, Inc.) is attached to the tip of an all plastic disposable syringe (available from Tokyo Garasu Kikai Co., Ltd.) to which is attached a syringe filter (diameter: 13 mm/pore diameter: 0.45 μm, available from Advantec Toyo Kaisha, Ltd.), and 0.200 mL of a supernatant liquid of a standard dispersed solution is collected.

The supernatant liquid collected with the syringe is injected into the DC24000 disk centrifuging type particle size distribution measurement apparatus, and the particle size distribution derived from the external additive B is calculated. During this process, measurement conditions for the DC24000 disk centrifuging type particle size distribution measurement apparatus are set according to the true density measured in advance. A peak derived from the external additive B is then determined, and the particle diameter of the peak top is deemed to be a number average particle diameter of the external additive B.

An example of a measurement method using the DC24000 disk centrifuging type particle size distribution measurement apparatus is given below.

First, the disk is rotated at 24,000 rpm by means of the Motor Control in CPS software. The following conditions are then set from the Procedure Definitions.

Case where the true density of the external additive is 1.60 g/cm$^3$ (1) Sample Parameter
Maximum Diameter: 1.0 μm
Minimum Diameter: 0.02 μm
Particle Density: 1.60 g/mL
Particle Refractive Index: 1.45
Particle Absorption: 0.1 K
Non-Sphericity Factor: 1.10
(2) Calibration Standard Parameters
Peak Diameter: 0.226 μm
Half Height Peak Width: 0.10 μm
Particle Density: 1.389 g/mL
Fluid Density: 1.004 g/mL
Fluid Refractive Index: 1.3382
Fluid Viscosity: 0.601 cps After setting the conditions mentioned above, a density gradient solution is prepared from a 1.0 mass % aqueous solution of sucrose and an 8.0 mass % aqueous solution of sucrose using an AG300 autogradient maker available from CPS Instruments, Inc., and 14.0 mL of this density gradient solution is injected into a measurement vessel.

Following the injection, an oil film is formed by injecting 1.0 mL of dodecane (available from Kishida Chemical Co., Ltd.) in order to prevent evaporation of the density gradient solution, and a waiting period of 30 minutes or more is then provided in order for the apparatus to stabilize.

Following the waiting period, standard particles for calibration (weight-based median particle diameter: 0.226 μm) is introduced into the measurement apparatus using a 0.10 mL syringe, and calibration is carried out. The collected supernatant liquid is then injected into the apparatus and the weight-based particle size distribution is measured.

In cases where the external additive B and another external additive are externally added to the toner, the number average particle diameter of the external additive B is measured in the following way.

10 g of toner is suspended in 200 mL of methanol, an ultrasonic wave treatment is carried out for 30 minutes using an SC-103 ultrasonic disperser (available from SMT Corporation), and the external additive B and other external additive are separated from the toner particle and left to stand for 24 hours. The sedimented toner particles are separated from the supernatant liquid in which the external additive B and the other external additive are dispersed.

In cases where the external additive B and the other external additive have different true densities, the external additives are separated by means of centrifugal separation, and the true density of each external additive is measured using a dry automatic density measuring apparatus. In cases where the true densities are different, measurement conditions for the disk centrifuging type particle size distribution measurement apparatus are different, but the number average particle diameters are measured by carrying out analysis under these different measurement conditions.

In cases where the external additive B and the other external additive have the same true density, the true density is measured using a dry automatic density measuring apparatus, and the number average particle diameters of the external additives are measured under the same measurement conditions using a disk centrifuging type particle size distribution measurement apparatus.

<Measurement of Adhesion Index of External Additive B>

As a means for obtaining an index for the state of adhesion of the external additive B, the migrated amount of the external additive B is evaluated when the toner is brought into contact with a substrate. As the material of the surface layer of the substrate, a substrate obtained using a polycarbonate resin in a surface layer material is used as a substrate for imitating a surface layer of a photosensitive member in the present invention. Specifically, a coating liquid is first obtained by dissolving a bisphenol Z type polycarbonate resin (product name: Iupilon Z-400, available from Mitsubishi Engineering-Plastics Corporation, viscosity average molecular weight (Mv): 40,000) is dissolved in toluene at a concentration of 10 mass %.

A coating film is then formed by coating this coating liquid on an aluminum sheet having a thickness of 50 μm using a #50 Meyer bar. This coating film is then dried for 10 minutes at 100° C. so as to prepare a sheet having a polycarbonate resin layer (having a thickness of 10 μm) on the aluminum sheet. This sheet is held by a substrate holder. The substrate has the shape of a square measuring approximately 3 mm on each side.

An explanation will now be given by dividing a measurement step into a step for disposing the toner on the substrate, a step for removing the toner from the substrate, and a step for quantifying the adhered amount of external additive B supplied to substrate.

Step for Disposing Toner on Substrate

The toner is incorporated in a porous flexible material (hereinafter referred to as a "toner holding body"), and the toner holding body is brought into contact with the substrate. A sponge (product name: White Wiper, available from Marusan Industry Co., Ltd.) is used as the toner holding body.

The toner holding body is fixed to the tip of a load gauge that is fixed to a stage that moves in a vertical direction relative to the contact face of the substrate, and is configured so that the toner holding body and the substrate can be in contact while the load is being measured. Contact between the toner holding body and the substrate causes the stage to move, and with one step comprising pushing the toner holding body onto the substrate until the load gauge indicates 10 N and then separating the toner holding body from the substrate, this step is repeated five times.

Step for Removing Toner from Substrate

A suction port, which is connected to the tip of a nozzle of a vacuum cleaner, has an internal diameter of approximately 5 mm and is made of an elastomer, is brought close to the substrate following contact with the toner holding body so as to be perpendicular to the surface on which the toner is disposed, and the adhered toner is removed from the substrate. During this process, remaining toner is removed while being visually confirmed. The distance between the tip of the suction port and the substrate is 1 mm, the suction time is 3 seconds, and the suction pressure is 6 kPa.

Step for Quantifying Adhered Amount of External Additive Supplied to Substrate

Scanning electron microscope observations and image measurement are used when quantifying the amount and shape of the external additive B remaining on the substrate following removal of the toner.

First, an observation sample is obtained by sputtering platinum for 60 seconds at a current of 20 mA on the substrate from which the toner has been removed.

In the observations with a scanning electron microscope, the magnification ratio is selected as appropriate in order to be able to observe the external additive B. Using a Hitachi ultrahigh resolution field emission scanning electron microscope (product name: S-4800, available from Hitachi High-Technologies Corporation) as the scanning electron microscope, observations are carried out using backscattered electron images from the S-4800 (product name). The magnification ratio is 50,000 times, the accelerating voltage is 10 kV, and the working distance is 3 mm. Under these conditions, it is possible to differentiate and observe particle diameters of the external additive B.

Because the external additive B is shown by high brightness parts and the substrate is shown by low brightness parts in images obtained using these observations, it is possible to quantify the amount of the external additive B in the field of view through binarization. Binarization conditions are selected appropriately in view of the observation apparatus and sputtering conditions. In the present invention, Image J image analysis software (available from https://imagej.nih-.gov/ij/) is used for binarization. Following binarization, only external additive B that corresponds to primary particles of external additive B having sizes of 30 to 200 nm are extracted.

In Image J, this extraction is possible by checking Area and Feret's Diameter in Set Measurement and using the Analyze Particle function. The areal ratio of the external additive B within the observed field of view is determined by totaling only the area of external additive B that corresponds to primary particles of external additive B having sizes of 30 to 200 nm from results obtained using the Analyze Particle function and dividing by the total area of the observed field of view. These measurements were carried out for 100 binarized images, and the average value thereof was taken to be the areal ratio [A] (units: area %) of the external additive B on the substrate.

Next, the coverage ratio [B] (units: area %) of the external additive B on the toner particle is calculated.

The coverage ratio of the external additive B is calculated using scanning electron microscope observations and image measurements. In scanning electron microscope observations, the magnification ratio for observing the external additive B is the same as the magnification ratio used for observing the external additive B on the substrate. A Hitachi ultrahigh resolution field emission scanning electron microscope (product name: S-4800, available from Hitachi High-Technologies Corporation) is used as the scanning electron microscope.

Image capture conditions are as follows.

(1) Sample Preparation

An electrically conductive paste is thinly coated on a sample stand (an aluminum sample stand measuring 15 mm×6 mm), and a toner is sprayed onto this paste. Excess toner is blown from the sample stand using an air blower, and the paste is then thoroughly dried. The sample stand is placed on a sample holder, and the sample stand height is adjusted to a height of 36 mm using a sample height gauge.

(2) Setting S-4800 Observation Conditions

The coverage ratio [B] the external additive B is calculated using images obtained from S-4800 backscattered electron images. Because backscattered electron images are lower than secondary electron images in terms of charge up, the coverage ratio [B] of the external additive B can be measured with good precision.

Liquid nitrogen is poured into an anti-contamination trap fitted to the housing of the S-4800 until the liquid nitrogen overflows, and the anti-contamination trap is then allowed to stand for 30 minutes. The S-4800 "PC-SEM" is started, and flushing is carried out (an FE chip that is an electron source is cleaned). The accelerating voltage display section on the control panel of the screen is clicked, the "Flushing" button is pressed, and the flushing dialogue is opened. Flushing is carried out after confirming that the flushing strength is 2. It is confirmed that the emission current from the flushing is 20 to 40 μA. The sample holder is inserted into a sample chamber in the S-4800 housing. "Start Point" on the control panel is pushed, and the sample holder is moved to the observation position.

The HV settings dialog is opened by clicking the accelerating voltage display section, and the accelerating voltage is set to "0.8 kV" and the emission current is set to "20 μA". Signal selection is set to "SE" in the "Basics" tab on the operation panel, "Upper (U)" and "+BSE" are selected for the SE detector, "L.A.100" is selected in the selection box on the right of "+BSE", and the apparatus is set to a mode in which observation is carried out with a backscattered electron image. Similarly, the probe current is set to "Normal", the focusing mode is set to "UHR" and WD is set to "3.0 mm" in the electron optical system conditions block in the "Basics" tab on the operation panel. The "ON" button is pushed on the accelerating voltage display section of the control panel, and an accelerating voltage is applied.

(3) Focus Adjustment

The magnification ratio display section of the control panel is dragged to a magnification ratio of 5,000 (5 k) times. Aperture alignment is adjusted by rotating the "COARSE" focusing button on the operation panel and focusing is more or less in focus throughout the field of view. "Align" on the control panel is clicked, the alignment dialog is displayed, and "Beam" is selected. The STIGMA/ALIGNMENT buttons (X, Y) on the operation panel are rotated, and the displayed beam is moved to the center of concentric circles. Next, "Aperture" is selected, the STIGMA/ALIGNMENT buttons (X, Y) are rotated once each so as to line up with each other so that image movement is stopped or minimum movement is attained. The Aperture dialog is closed, and focusing is achieved through autofocus. Focusing is achieved by repeating this procedure a further two times.

Next, the magnification ratio display section of the control panel is dragged to a magnification ratio of 10,000 (10 k) times for the toner in question in a state whereby the middle point of the maximum diameter lines up with the center of the measurement screen. Aperture alignment is adjusted by rotating the "COARSE" focusing button on the operation panel and focusing is more or less in focus. "Align" on the control panel is clicked, the alignment dialog is displayed, and "Beam" is selected. The STIGMA/ALIGNMENT buttons (X, Y) on the operation panel are rotated, and the displayed beam is moved to the center of concentric circles.

Next, "Aperture" is selected, the STIGMA/ALIGNMENT buttons (X, Y) are rotated once each so as to line up with each other so that image movement is stopped or minimum movement is attained. The Aperture dialog is closed, and focusing is achieved through autofocus. Next, the magnification ratio is set to 50,000 (50 k) times, focus adjustment is carried out using the focusing button and STIGMA/ALIGNMENT buttons in the same way as mentioned above, and focusing is again achieved through autofocus. Focusing is achieved by repeating this procedure. Here, because coverage ratio measurement precision tends to decrease as the angle of inclination of the observation surface increases, analysis is carried out by selecting a surface having less inclination as possible by selecting in such a way that the entire observation surface is in focus at the same time when focus adjustment is carried out.

(4) Image Storage

Brightness adjustment is carried out in ABC mode, and a photograph is taken at a size of 640×480 pixels and stored. This image file is analyzed in the manner described below. One photograph is taken for each toner, and images are obtained for at least 30 particles of toner.

Observed images are binarized using Image J image analysis software (available from https://imagej.nih.gov/ij/). Following binarization, only external additive B that corresponds to a Feret's diameter a (nm) of 60 to 200 nm is extracted, and the coverage ratio (units: area %) of the external additive B on the toner particle is determined.

These measurements are carried out for 100 binarized images, and the average value of the coverage ratio (units: area %) of the external additive B is taken to be the coverage ratio [B] of the external additive B. The adhesion index of the external additive B is calculated from the areal ratio [A] and coverage ratio [B] of the external additive B on the substrate using the formula below.

Adhesion index of external additive $B$=areal ratio [$A$] of external additive $B$ on substrate/coverage ratio [$B$] of external additive $B$×100

<Measurement of Nb/Na>

The value of Nb/Na is measured using a "S-4800" scanning electron microscope. In a field of view having a magnification of 30,000 times, 50 particles of toner to which the external additive B has been externally added are observed in a random manner at accelerating voltages of 1.0 kV and 5.0 kV using the same field of view.

Nb and Na are calculated from the images in the manner described below using "Image J" image processing software (available from https://imagej.nih.gov/ij/).

Images observed at an accelerating voltage of 1.0 kV are binarized by setting "Image-Adjust-Threshold" and setting threshold values in the displayed dialog box so that only the external additive B is extracted.

Next, "Analyze-Set Measurements" is selected, and "Perimeter" and "Area" are checked in the displayed dialog box.

A 2 μm square region from the center of the binarized image is used as the analysis region, "Analyze-Analyze Particle" is selected, "Size" and "Circularity" corresponding to the external additive B are set, the procedure is run, and the number of particles of the external additive B is calculated. Here, the object of the calculations is the external additive B corresponding to primary particles having sizes of 30 to 200 nm.

Next, images observed at an accelerating voltage of 5.0 kV are binarized so that the inorganic fine particles A and the external additive B are extracted, using the same apparatus and procedure as those used for images observed at an accelerating voltage of 1.0 kV.

Following binarization, "Process-Image Calculator" is selected. In the displayed dialog box, "Image 1" is a binarized image of an image observed at an accelerating voltage of 5.0 kV and "Image 2" is a binarized image of an image observed at an accelerating voltage of 1.0 kV, and a differential image is created by selecting "Subtract" as the "Operation". A 2 μm square region from the center of the differential image is used as the analysis region, "Analyze-Analyze Particle" is selected, "Mask" is set for "Show" in the displayed dialog box, the procedure is run, and the number of particles of the external additive B that observed in a state of completely overlapping with the inorganic fine particles A is calculated.

The difference between the simultaneously obtained Mask image and the binarized image observed at an accelerating voltage of 5.0 kV is determined using "Process-Image Calculator". For this differential image, "Analyze-Analyze Particle" is selected, "Size" and "Circularity" in the dialog box are set to be lower values than those for the external additive B, and the procedure is run. From the area of the external additive B and the area of the external additive B that observed in a state of overlapping with the inorganic fine particles A, which is calculated using the procedure described above, the number of particles which are not observed in a state of completely overlapping with but for which at least half the area being observed in a state of overlapping with the inorganic fine particles A is calculated. The number of particles being observed in a state of completely overlapping is added to the number of particles which are not observed in a state of completely overlapping with but for which at least half the area being observed in a state of overlapping with the inorganic fine particles A to give the number of particles of the external additive B that observed in a state of overlapping with the inorganic fine particles A.

This procedure was carried out for all 50 observed images, and the number Na of particles of the external additive B and the number Nb of particles of the external additive B that observed in a state of overlapping with the inorganic fine particles A are calculated from the average value thereof.

<Surface Abundance of Inorganic Fine Particles A>

The surface abundance of the inorganic fine particles A is measured by separating the external additive B from the toner to which the external additive B has been externally added.

1 g of toner is suspended in 20 mL of methanol, an ultrasonic wave treatment is carried out for 30 minutes using an SC-103 ultrasonic disperser (available from SMT Corporation), and the external additive B is separated from the toner particle and left to stand for 24 hours. The sedimented toner particles and the external additive B dispersed in the supernatant liquid are separated, recovered and dried for 24 hours at 50° C. so as to isolate the toner particles.

50 particles of the isolated toner are observed in a random manner at an accelerating voltage of 5.0 kV in a field of view having a magnification of 10,000 times using a "S-4800" scanning electron microscope.

The surface abundance of the inorganic fine particles A is calculated from the observed image in the manner described below using "Image J" image processing software (available from https://imagej.nih.gov/ij/).

Observed images are binarized by selecting "Image-Adjust-Threshold" and setting threshold values in the displayed dialog box so that overall toner particles are extracted. The same images are binarized using the same procedure, but by altering only threshold values so that only the inorganic fine particles A are extracted. For each of these images, the numbers of pixels having brightnesses corresponding to the overall toner particle and the inorganic fine particles A are determined from "Analyze-Histogram", and the areas of these are calculated. The surface abundance of the inorganic fine particles A is calculated from the obtained areas using the formula below.

Surface abundance of inorganic fine particles $A$=area of overall inorganic fine particles $A$/area of overall toner particle×100

The surface abundance of the inorganic fine particles A is calculated for all of the observed toner particles, and the average value thereof is used.

<Method for Measuring Coverage Ratio of External Additive B>

The coverage ratio of the toner particle surface by the external additive B is calculated in the manner described below.

Elemental analysis of the toner surface is carried out using the apparatus and conditions described below.

Measurement apparatus: Quantum 2000 (product name, available from Ulvac-Phi, Inc.)

X-Ray source: Monochromated Al Kα

X-Ray settings: 100 μmφ (25 W (15 kV))

Photoelectron take out angle: 45°

Neutralization conditions: Neutralizing gun and ion gun

Analysis region: 300 μm×200 μm

Pass energy: 58.70 eV

Step size: 0.125 eV

Analysis software: Multipak (available from Ulvac-Phi, Inc.)

An explanation will now be given of a case in which, for example, the external additive B contains silica fine particles. In cases where the coverage ratio is to be determined, a quantified value for silicon atoms is calculated using C 1c (B.E. 280 to 295 eV), O 1s (B.E. 525 to 540 eV) and Si 2p (B.E. 95 to 113 eV) peaks.

The thus obtained quantified value for silicon atoms is denoted by Y1.

Next, silica fine particles are singly subjected to elemental analysis in the same way as the elemental analysis of the toner particle surface described above, and the thus obtained quantified value for silicon atoms is denoted by Y2.

The coverage ratio of the toner particle surface by silica fine particles is defined from the formula below using the values of Y1 and Y2.

$$X1(\text{area }\%)=(Y1/Y2)\times 100$$

Measurements are carried out 100 times using the same sample, and the arithmetic mean value of these measurements is used.

In addition, in cases where a plurality of external additives B are used, the coverage ratio mentioned above is determined for each of the external additives B, and a value obtained by totaling these coverage ratios is used.

When determining the quantified value Y2, if the external additive B used for the external addition can be procured, measurements should be carried out using this.

In addition, in cases where an external additive B that has been separated from the toner particle surface is to be used as a measurement sample, the external additive B is separated from the toner particle using the following procedure.

1) Case of Non-Magnetic Toner

A concentrated sucrose solution is prepared by adding 160 g of sucrose (available from Kishida Chemical Co., Ltd.) to 100 mL of ion exchanged water and dissolving the sucrose while immersing in hot water. A dispersed solution is prepared by placing 31 g of the concentrated sucrose solution and 6 mL of Contaminon N in a centrifugal separation tube. 1 g of toner is added to this dispersed solution and lumps of the toner are broken into smaller pieces using a spatula or the like.

The centrifugal separation tube is shaken for 20 minutes in the shaker described above at a rate of 350 reciprocations per minute. Following the shaking, the solution is transferred to a (50 mL) swing rotor glass tube and subjected to centrifugal separation for 30 minutes at a rate of 58.33 $S^{-1}$ using a centrifugal separator (H-9R, available from Kokusan Co., Ltd.). The toner is present in the uppermost layer and the external additive B is present in the aqueous solution side of the lower layer in the glass tube following the centrifugal separation. The aqueous solution in the lower layer is collected and subjected to centrifugal separation so as to separate sucrose from the external additive B, and the external additive B is collected. If necessary, the centrifugal separation is repeated, and once sufficient separation has been achieved, the dispersed solution is dried and the external additive B is collected.

In cases where a plurality of external additives are used, the external additive B should be sorted from the collected external additives using a centrifugal separation method or the like.

2) Magnetic Toner

First, a dispersion medium is prepared by placing 6 mL of Contaminon N (a 10 mass % aqueous solution of a neutral detergent for cleaning precision measurement equipment, which has a pH of 7 and comprises a non-ionic surfactant, an anionic surfactant and an organic builder, available from Wako Pure Chemical Industries, Ltd.) in 100 mL of ion exchanged water. 5 g of toner is added to this dispersion medium and dispersed for 5 minutes using an ultrasonic disperser (a VS-150 available from As One Corporation). Next, the dispersion medium is placed on a "KM Shaker" (model: V. SX) available from Iwaki Sangyo Co., Ltd., and shaken for 20 minutes at a rate of 350 reciprocations per minute. The toner particles are then constrained using a neodymium magnet, and the supernatant liquid is collected. The external additive is collected by drying this supernatant liquid. In cases where a sufficient quantity of external additive cannot be collected, this procedure is repeated.

In the same way as for a non-magnetic toner, in cases where a plurality of external additives are used, the external additive B should be sorted from the collected external additives using a centrifugal separation method or the like.

<Dispersion Evaluation Index of External Additive B at Toner Surface>

The dispersion evaluation index of the external additive B at the toner surface is calculated using an "S-4800" scanning electron microscope. In a field of view having a magnification of 10,000 times, a toner to which the external additive B has been externally added was observed at an accelerating voltage of 1.0 kV using the same field of view. The dispersion evaluation index was calculated from the images in the manner described below using "Image J" image processing software (available from https://imagej.nih.gov/ij/).

Binarization was carried out so that only the external additive B was extracted, the number n of particles of external additive and the center of gravity coordinates relative to all external additives was calculated, and the distance dn min from the closest external additive to each external additive was calculated. The average value of the closest distance between external additives in the image is denoted by d ave, and the degree of dispersion is represented by the formula below.

$$\text{Dispersion evaluation index} = \sqrt{\frac{\Sigma_1^n (dn\ \min - d\ ave)^2}{n}} / d\ ave$$

The degree of dispersion was calculated for 50 randomly observed toners using the procedure described above, and the average value thereof was taken to be the dispersion evaluation index. A smaller dispersion evaluation index means better dispersibility.

<Shape Factor of External Additive B>

The shape factor SF-2 of the external additive B is measured using a "S-4800" scanning electron microscope (available from Hitachi, Ltd.). A toner to which the external additive B had been externally added was observed, and the shape factor was calculated in the manner described below. The magnification rate was adjusted as appropriate according to the size of the external additive B. In a field of view magnified at a maximum of 500,000 times, the peripheral length and area of 100 randomly selected primary particles of the external additive B were calculated using "Image J" image editing software (available from https://imagej.nih.gov/ij/).

SF-2 was calculated for the 100 particles of the external additive B using the formula below, and the average value thereof was used.

$$\text{SF-2} = (\text{peripheral length of particle})^2 / \text{area of particle} \times 100/4\pi$$

<Method for Measuring Toner Strength by Nanoindentation>

A Picodentor HM500 available from Fischer Instruments K.K. is used for measurements of toner strength by nanoindentation. The software used is WIN-HCU. A Vickers indenter (angle: 130°) is used as an indenter.

Measurements comprise a step for indenting with the indenter mentioned above for a prescribed period of time until a prescribed load is reached (hereinafter referred to as an "indentation step"). In these measurements, the load application speed is altered by altering the preset time and load.

First, a microscope is focused using a video camera screen which is connected to the microscope and displayed by software. Moreover, a target to be focused is a glass plate (hardness: 3,600 N/mm$^2$) subjected to the Z axis alignment described below. Here, the object lens is sequentially focused from 5 times magnification to 20 times magnification and 50 times magnification. Thereafter, adjustment is carried out using an object lens having a degree of magnification of 50.

Next, an "approach parameter settings" procedure is carried out using the glass plate that has been subjected to the focusing mentioned above, and the indenter is aligned with the Z axis. An "indenter cleaning" procedure is then carried out after switching from a glass plate to an acrylic plate. The "indenter cleaning" procedure is a procedure in which an indenter position designated by the software is matched with the indenter position on the hardware while cleaning the tip of the indenter with a cotton bud soaked with ethanol, that is, a procedure in which the indenter is aligned with X and Y axes.

The focal point of the microscope is then aligned with the toner to be measured after switching to a glass slide to which the toner is adhered. The method for causing the toner to adhere to the glass slide is as follows.

First, the toner to be measured is caused to adhere to the tip of the cotton bud, and excess toner is screened out using the edge of the bottle, or the like. Next, while pushing the shaft of the cotton bud against the edge of the glass slide, toner adhered to the cotton bud is knocked off so that toner on the glass slide forms a single layer.

The glass slide to which a single layer of toner has been adhered in the manner described above is placed in the microscope, the focal point is matched with the toner using an object lens having a degree of magnification of 50, and the tip of the indenter is set using software so as to reach the center of a toner particle. Moreover, the toner to be selected is limited to particles in which both the long axis and short axis are within +1.0 μm of the weight average particle diameter D4 (μm) of the toner particles.

Measurements are made by carrying out indentation steps under the following conditions.

(Indentation Step 1)

Maximum indentation load=0.25 mN

Indentation time=300 seconds

Under these conditions, an indentation speed of 0.83 μN/sec can be set.

(Indentation Step 2)

Maximum indentation load=0.50 mN

Indentation time=200 seconds

Under these conditions, a load application speed of 2.5 μN/sec can be set.

In these two indentation steps, the toner hardness A and B is defined as the inclination determined by linear approximation by the least-squares method of data in a displacement region of 0.00 to 0.20 μm from a load-displacement curve obtained using a load a (mN) as the vertical axis and a displacement amount b (μm) as the horizontal axis. Moreover, the displacement measured under the initial positive load is defined as the initial displacement value (0.00 μm). In addition, at least 100 points of data are collected within the region 0.00 to 0.20 μm.

These measurements are carried out for 30 particles of toner, and the arithmetic mean value thereof is used.

For the measurements, the "indenter cleaning" procedure (including the X-Y axis alignment of the indenter) mentioned above is always carried out between each particle measurement.

<Method for Measuring Weight-Average Particle Diameter (D4)>

The weight-average particle diameter (D4) of the toner and the toner particle is calculated by analyzing measurement data resulting from a measurement, in 25,000 effective measurement channels, using;

a precision particle diameter distribution measurement apparatus "Coulter Counter Multisizer 3" (tradename, by Beckman Coulter, Inc.) relying on a pore electrical resistance method and equipped with a 100 μm aperture tube, and by using dedicated software "Beckman Coulter Multisizer 3, Version 3.51" (tradename, by Beckman Coulter, Inc.) ancillary to the apparatus, for setting measurement conditions and analyzing measurement data.

The aqueous electrolyte solution used in the measurements can be prepared through dissolution of special-grade sodium chloride at a concentration of about 1 mass % in ion-exchanged water; for instance "ISOTON II" (by Beckman Coulter, Inc.) can be used herein.

The dedicated software was set up as follows prior to measurement and analysis.

In the "Changing Standard Operating Mode (SOM)" screen of the dedicated software, a total count of the control mode is set to 50,000 particles, a number of runs is set to one, and a Kd value is set to a value obtained using "Standard particles 10.0 μm" (by Beckman Coulter, Inc.). The threshold/noise level measuring button is pressed to thereby automatically set a threshold value and a noise level. Then the current is set to 1600 μA, the gain is set to 2, the electrolyte solution is set to ISOTON II (tradename), and flushing of the aperture tube following measurement is ticked.

In the "setting conversion from pulses to particle size" screen of the dedicated software, the bin interval is set to a logarithmic particle diameter, the particle diameter bin is set to 256 particle diameter bins, and the particle diameter range is set to range from 2 μm to 60 μm.

Specific measurement methods are as described below.

(1) Herein approximately 200 mL of the aqueous electrolyte solution is placed in a 250 mL round-bottomed glass beaker dedicated to Multisizer 3. The beaker is set on a sample stand and is stirred counterclockwise with a stirrer rod at 24 rotations per second. Debris and air bubbles are then removed from the aperture tube by the "aperture tube flush" function of the dedicated software.

(2) Then about 30 mL of the aqueous electrolyte solution is placed in a 100 mL flat-bottomed glass beaker, and about 0.3 mL of a dilution is added thereto as a dispersant. The dilution contains a dispersant "Contaminon N" (tradename, by FUJIFILM Wako Pure Chemical Industries, Ltd.) diluted thrice by mass in ion-exchanged water. "Contaminon N" (tradename) is 10 mass % aqueous solution of a pH 7 neutral detergent for cleaning of precision instruments, comprising a nonionic surfactant, an anionic surfactant and an organic builder.

(3) A predetermined amount of ion-exchanged water is placed in a water tank of an ultrasonic disperser "Ultrasonic Dispersion System Tetora 150" (by Nikkaki Bios Co., Ltd.) ", and about 2 mL of the above Contaminon N (tradename) are added into the water tank. "Ultrasonic Dispersion System Tetora 150" is an ultrasonic disperser having an electrical output of 120 W and internally equipped with two oscillators that oscillate at a frequency of 50 kHz and are disposed at a phase offset of 180 degrees.

(4) The beaker of (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, about 10 mg of the toner are added little by little to the aqueous electrolyte solution, to be dispersed therein. The ultrasonic dispersion treatment is further continued for 60 seconds. The water temperature of the water tank at the time of ultrasonic dispersion is adjusted as appropriate to lie in the range of from 10° C. to 40° C.

(6) The aqueous electrolyte solution of (5) containing the dispersed toner is added dropwise, using a pipette, to the round-bottomed beaker of (1) set on the sample stand, to adjust the measurement concentration to about 5%. A measurement is then performed until the number of measured particles reaches 50,000.

(7) Measurement data is analyzed using the dedicated software ancillary to the apparatus, to calculate the weight-average particle diameter (D4). The "arithmetic size" in the analysis/volume statistics (arithmetic average) screen, when graph/% by volume is selected in the dedicated software, yields herein the weight-average particle diameter (D4).

<Calculation of X and Y of External Additive B in Toner Cross Section Observations>

(1) TEM Cross Section Observations

A toner is thoroughly dispersed in a visible light-curable resin (product name: Aronix LCR Series D-800, available from Toagosei Co., Ltd.), and then cured through irradiation with short wavelength light. A thin sample measuring 250 nm is produced by cutting the obtained cured product using an ultramicrotome equipped with a diamond knife. Next, the cut sample is magnified at a degree of magnification of 40,000 to 50,000 times using a transmission electron microscope (a JEM-2800 electron microscope available from JEOL Ltd.) (TEM-EDX), and element mapping from the toner cross section is carried out using external additive observations and EDX.

Moreover, the toner to be observed is selected in the manner described below.

First, the toner cross section area is determined from the toner cross-section image, and the diameter (circle-equivalent diameter) of a circle having the same area as this cross-section area is determined. Observations are carried out using only toner cross-section images in which the absolute value of the difference between this circle-equivalent diameter and the weight average particle diameter (D4) of the toner is within 1.0 μm. Mapping conditions are such that the storage rate is 9,000 to 13,000, and the number of accumulations is 120.

(2) Methods for Calculating Maximum Diameter (Feret's Diameter) X, Maximum Embedded Length Y, and Value of Y/X of External Additive B A TEM image, which is obtained by cutting a portion measuring 400 nm from the surface of the external additive B towards the inside of the toner particle, is expanded and subjected to image editing so that the toner particle surface is a straight line (that part of the toner particle surface other than the part in which the external additive B is embedded is a straight line, as shown in FIGS. 14A and 14B).

In addition, a line connecting the ends of the interface between the toner particle surface and the external additive B is drawn along the toner particle surface formed as a straight line.

Next, the maximum diameter (Feret's diameter) X (nm) of the external additive B is first determined, as shown in FIGS. 14A and 14B. In addition, the coordinates of the center of the external additive B are calculated, a straight line which passes through these center coordinates and which is orthogonal to the line connecting the ends of the interface between the toner particle surface and the external additive B is drawn, and the coordinates of this point of intersection are calculated. In addition, the distance L (nm) to this point of intersection from the coordinates of the center of the external additive B is determined. Moreover, the position of the center of gravity, as determined by image editing, is taken to be the coordinates of the center of the external additive B. Next, the maximum embedded length Y (nm) is calculated from the maximum diameter X of the external additive and the distance L (nm) using the formulae below.

<FIG. 14A: Case where the Center of the External Additive is Higher than the Toner Particle Surface>

$$\text{Maximum embedded length } Y(\text{nm})=X/2-L$$

<FIG. 14B: Case where the Center of the External Additive is Inside the Toner Particle>

$$\text{Maximum embedded length } Y(\text{nm})=X/2+L$$

The value of Y/X is determined from the values of X and Y.

Moreover, "Image J" (available from https://imagej.nih-.gov/ij/) is used for image editing. In addition, 20 particles of the external additive B are analyzed, and average values are taken to be the values of X and Y of the sample.

Furthermore, the standard deviation of Y/X is also determined.

<Method for Measuring Tg>

The glass transition temperature (Tg) of the toner particle is measured in accordance with ASTM D3418-82 using a "Q2000" differential scanning calorimeter (available from TA Instruments). Temperature calibration of the detector in the apparatus is performed using the melting points of indium and zinc, and heat amount calibration is performed using the heat of fusion of indium.

A sample obtained by precisely weighing out 2 mg of toner is used as a measurement sample. This is placed in an aluminum pan, and an empty aluminum pan is used as a reference. The measurement temperature range is 30° C. to 200° C., and the temperature is first increased from 30° C. to 200° C. at a ramp rate of 10° C./min, then decreased from 200° C. to 30° C. at a cooling rate of 10° C./min, and then again increased to 200° C. at a ramp rate of 10° C./min. On a DSC curve obtained in the second temperature increase step, the glass transition temperature Tg is deemed to be the point at which the differential thermal analysis curve intersects with the line at an intermediate point on the baseline before and after a change in specific heat occurs.

EXAMPLES

The present invention will now be explained in greater detail by means of the following examples and comparative examples, but is in no way limited to these examples. Numbers of parts used in the examples mean parts by mass unless explicitly indicated otherwise.

An explanation will now be given of a production example of the external additive B, which was used in the examples.

Production Example of Organic-Inorganic Composite Fine Particles 1

Particles produced in accordance with Working Example 1 in WO 2013/063291 were prepared as organic-inorganic composite fine particles 1. Physical properties of organic-inorganic composite fine particles 1 are shown in Table 1.

Production Examples of Silica Fine Particles 1 to 5

Silica fine particles 1 to 5 were prepared by surface treating 100 parts of base material silica fine particles 1 to 5 with 15 parts of hexamethyldisilazane (HMDS). Physical properties of silica fine particles 1 to 5 are shown in Table 1.

TABLE 1

| Type of external additive | Number average particle diameter of primary particles (nm) | Shape factor SF-2 |
|---|---|---|
| Organic-inorganic composite fine particles 1 | 106 | 116 |
| Silica fine particles 1 | 100 | 100 |
| Silica fine particles 2 | 180 | 120 |
| Silica fine particles 3 | 40 | 101 |
| Silica fine particles 4 | 210 | 125 |
| Silica fine particles 5 | 25 | 108 |

An explanation will now be given of a production example of inorganic fine particles A, which were used in the examples.

Production Example of Magnetic Body 1

An aqueous solution containing ferrous hydroxide was prepared by mixing a caustic soda solution (containing sodium hexametaphosphate at a quantity of 1 mass % in terms of P relative to Fe) at a quantity of 1.0 equivalents relative to iron ions with an aqueous solution of ferrous sulfate. A slurry liquid for generating a seed crystal was prepared by blowing air while maintaining the aqueous solution at a pH of 9 and carrying out an oxidation reaction for 70 minutes at 80° C.

Next, an aqueous solution of ferrous sulfate was added to this slurry liquid so as to attain a concentration of 1.0 equivalents relative to the original quantity of alkali (sodium content in the caustic soda). While maintaining the slurry liquid at a pH of 8 and blowing air, an oxidation reaction was carried out for 30 minutes and the pH was adjusted to 6 at the final stage of the oxidation reaction. As a silane coupling agent, $n\text{-}C_6H_{13}Si(OCH_3)_3$ was added at a quantity of 1.5 parts relative to 100 parts of magnetic iron oxide and stirred vigorously. The thus generated hydrophobic iron oxide particles were washed, filtered and dried using conventional methods. Magnetic body 1 was obtained by crushing aggregated particles and then carrying out a heat treatment for 5 hours at a temperature of 70° C. The number average particle diameter of magnetic body 1 was 0.25 μm.

Production Example of Magnetic Body 2

Magnetic body 2 was obtained in the same way as in the production example of magnetic body 1, except that the duration of the oxidation reaction for seed crystal generation was changed to 50 minutes and the added quantity of silane coupling agent was changed to 1.7 parts relative to 100 parts of magnetic iron oxide. The number average particle diameter of magnetic body 2 was 0.20 μm.

Production Example of Magnetic Body 3

Magnetic body 3 was obtained in the same way as in the production example of magnetic body 1, except that a silane coupling agent was not added. The number average particle diameter of magnetic body 3 was 0.25 μm.

Production Example of Toner Particle 1

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 85 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 1 was then obtained by cooling the suspension liquid to room temperature at a rate of 3° C./min, adding hydrochloric acid so as to dissolve the dispersing agent, and then filtering, washing with water and drying. Physical properties of obtained toner particle 1 are shown in Table 2.

Production Example of Toner Particle 2

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 40 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 2 was then obtained by cooling the suspension liquid to room temperature at a rate of 3° C./min, adding hydrochloric acid so as to dissolve the dispersing agent, and then filtering, washing with water and drying. Physical properties of obtained toner particle 2 are shown in Table 2.

Production Example of Toner Particle 3

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 30 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 3 was then obtained by cooling the suspension liquid to room temperature at a rate of 3° C./min, adding hydrochloric acid so as to dissolve the dispersing agent, and then filtering, washing with water and drying. Physical properties of obtained toner particle 3 are shown in Table 2.

Production Example of Toner Particle 4

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 20 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 4 was then obtained by cooling the suspension liquid to room temperature at a rate of 3° C./min, adding hydrochloric acid so as to dissolve the dispersing agent, and then filtering, washing with water and drying. Physical properties of obtained toner particle 4 are shown in Table 2.

Production Example of Toner Particle 5

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin: 3 parts

Negative charge control agent T-77 (available from Hodogaya Chemical Co., Ltd.): 1 part Magnetic body 1: 90 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 5 was then obtained by cooling the suspension liquid to room temperature at a rate of 3° C./min, adding hydrochloric acid so as to dissolve the dispersing agent, and then filtering, washing with water and drying. Physical properties of obtained toner particle 5 are shown in Table 2.

Production Example of Toner Particle 6

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 15 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 6 was then obtained by cooling the suspension liquid to room temperature at a rate of 3° C./min, adding hydrochloric acid so as to dissolve the dispersing agent, and then filtering, washing with water and drying. Physical properties of obtained toner particle 6 are shown in Table 2.

Production Example of Toner Particle 7

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 78 parts n-butyl acrylate: 22 parts

Divinylbenzene: 0.5 parts

Polyester resin: 3 parts

Negative charge control agent T-77 (available from Hodogaya Chemical Co., Ltd.): 1 part Magnetic body 2: 20 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 7 was then obtained by cooling the suspension liquid to room temperature at a rate of 3° C./min, adding hydrochloric acid so as to dissolve the dispersing agent, and then filtering, washing with water and drying. Physical properties of obtained toner particle 7 are shown in Table 2.

Production Example of Toner Particle 8

Amorphous polyester resin (Tg: 59° C., softening point Tm: 112° C.): 100 parts

Magnetic body 3: 85 parts

Fischer Tropsch wax (C105 available from Sasol, melting point: 105° C.): 2 parts Negative charge control agent (T-77 available from Hodogaya Chemical Co., Ltd.): 2 parts The materials listed above were premixed using an FM Mixer (available from Nippon Coke & Engineering Co., Ltd.), and melt kneaded using a twin-screw extruder (PCM-30 model, available from Ikegai Corporation) with the temperature set so that the temperature of the molten product at the discharge port was 150° C.

The obtained kneaded product was cooled, coarsely pulverized using a hammer mill, and then finely pulverized using a pulverizer (product name: Turbo Mill T250, available from Turbo Kogyo). Toner particle 8 was obtained by classifying the obtained finely pulverized powder using a multi-grade classifier using the Coanda effect. Physical properties of toner particle 8 are shown in Table 2.

Production Example of Toner Particle 9

An aqueous medium containing a dispersion stabilizer was obtained by introducing 450 parts of a 0.1 mol/L aqueous solution of $Na_3PO_4$ into 720 parts of ion exchanged water, heating to a temperature of 60° C., and then adding 67.7 parts of a 1.0 mol/L aqueous solution of $CaCl_2$.

Styrene: 72 parts n-butyl acrylate: 28 parts

Divinylbenzene: 0.5 parts

Polyester resin (Tg: 61° C., softening point Tm: 118° C.): 3 parts

Negative charge control agent T-77 (available from Hodogaya Chemical Co., Ltd.): 1 part Magnetic body 1: 15 parts The formulation mentioned above was uniformly dispersed and mixed using an attritor (available from Nippon Coke & Engineering Co., Ltd., formerly Mitsui Miike Kakoki K.K.). A polymerizable monomer composition was obtained by heating this monomer composition to a temperature of 60° C. and then mixing and dissolving the following materials.

Release agent (paraffin wax (HNP-9, available from Nippon Seiro Co., Ltd.)): 15 parts Polymerization initiator (t-butyl peroxypivalate (25% toluene solution)): 10 parts The polymerizable monomer composition mentioned above was introduced into the aforementioned aqueous medium, and granulation was carried out by stirring at a rate of 366.67 $S^{-1}$ for 15 minutes at a temperature of 60° C. in a $N_2$ atmosphere using a TK type homomixer (available from Tokushu Kika Kogyo Co., Ltd.). Stirring was then carried out using a paddle stirring blade, and a polymerization reaction was carried out for 300 minutes at a reaction temperature of 70° C. Toner particle 9 was then obtained by cooling the suspension liquid to room temperature at a rate of 3° C./min, adding hydrochloric acid so as to dissolve the dispersing agent, and then filtering, washing with water and drying. Physical properties of obtained toner particle 9 are shown in Table 2.

TABLE 2

| | Magnetic body | | Weight average | |
|---|---|---|---|---|
| | Type | Added amount (part) | particle diameter (D4) (μm) | Tg (° C.) |
| Toner particle 1 | Magnetic body 1 | 85 | 7.0 | 60 |
| Toner particle 2 | Magnetic body 1 | 40 | 6.9 | 61 |
| Toner particle 3 | Magnetic body 1 | 30 | 7.0 | 60 |
| Toner particle 4 | Magnetic body 1 | 20 | 7.1 | 61 |
| Toner particle 5 | Magnetic body 1 | 90 | 7.0 | 60 |
| Toner particle 6 | Magnetic body 1 | 15 | 7.0 | 60 |
| Toner particle 7 | Magnetic body 2 | 20 | 7.1 | 61 |
| Toner particle 8 | Magnetic body 3 | 85 | 7.0 | 60 |
| Toner particle 9 | Magnetic body 1 | 15 | 7.0 | 50 |

<Mixing Process Apparatus 1>

Mixing process apparatus 1 shown in FIG. 2 was used. An apparatus in which the diameter of the inner periphery of a main body casing 31 was 130 mm and the volume of a processing space 39 was $2.0\times10^{-3}$ $m^3$ was used, the rated power of a drive member 38 was 5.5 kW, and the shape of a stirring member 33 was as shown in FIG. 3. In addition, the overlapping width d of a stirring member 33*a* and a stirring member 33*b* in FIG. 3 was 0.25 D relative to the maximum width D of the stirring member 33, and the clearance between a stirring member 33 and the inner periphery of the main body casing 31 was 3.0 mm. The temperature was regulated by streaming a cooling/heating medium in a jacket.

<Mixing Process Apparatus 2>

Mixing process apparatus 2 shown in FIG. 4 was used. A processing tank 110 was a cylindrical container having an internal height of 250 mm, an internal diameter φ of 230 mm and an effective volume of 10 L, and was provided with a drive shaft 111 in the center of a flat bottom part, as shown in FIG. 5. The driving force from a drive motor 150 was transmitted to the drive shaft 111 via a drive belt 112.

Within the processing tank 110, a stirring vane 120 shown in FIGS. 6A and 6B was attached to the drive shaft 111 as a streaming means for streaming an object to be processed upwards from the bottom of the processing chamber. The stirring vane 120 was S-shaped and was shaped so that the tips of the vane curved upwards.

Furthermore, a processing vane 140 shown in FIGS. 7A and 7B was attached to the same drive shaft 111 as a rotating body at the top of the stirring vane 120. Processing sections 142 that protrude outwards in a radial direction from the outer peripheral surface of an annular main body 141 were provided at four locations on the processing vane 140. The shape of each processing section 142 was such that the outermost tip in the radial direction was 96% of the radius of the processing tank 110, and each processing section had a thickness of 6 mm.

Within the angle formed between a line connecting the closest point to the rotating member main body on the processing face and the position of 0.8 L shown in FIG. 9 and a tangent of the 0.8 L circle on the processing face in FIG. 9, the size (θ) of the angle on the downstream side in the direction of rotation was 100°.

Furthermore, a deflector 130 shown in FIG. 4 was attached to the processing vane 140, and a thermocouple (not shown) capable of monitoring the temperature of the toner particles in the processing tank was attached to the tip of the deflector 130.

In addition, the temperature was regulated by streaming a cooling/heating medium in a jacket (not shown) in the processing tank 110.

Production Example of Toner 1

Externally added toner 1 was obtained by mixing 100 parts of toner particle 1 and 1.0 parts of organic-inorganic composite particle 1 for 5 minutes at a rate of 60 $S^{-1}$ using mixing process apparatus 2. Mixing was initiated once the temperature had stabilized at 30° C., and the temperature was regulated to 30° C.±1° C. during the mixing.

Warm water was then passed through the jacket so that the temperature in mixing process apparatus 1, which was configured in the manner described above, was 55° C. Mixing was initiated once the temperature had stabilized at 55° C., and the temperature was regulated to 55° C.±1° C. during the mixing.

Externally added toner 1 was introduced into mixing process apparatus 1, and heating was then carried out for 10 minutes while regulating the peripheral velocity of the outermost end of the stirring member 33 so that the force of the drive member 38 was fixed at $1.5\times10^{-2}$ W/g (rotational speed of drive member 38: approximately 2.5 $S^{-1}$).

Following completion of the heating, toner 1 was obtained by sieving through a mesh having an opening size of 75 μm. Production conditions for toner 1 are shown in Table 3, and physical properties of toner 1 are shown in Table 4.

Production Examples of Toners 2 to 17 and Comparative Toners 1 to 8

Toners 2 to 17 and comparative toners 1 to 8 were obtained in the same was in the production example of toner 1, except that the toner particle, the external additive B, the mixing process apparatus and the production conditions are shown in Table 3. Physical properties of toners 2 to 17 and comparative toners 1 to 8 are shown in Table 4.

The number average particle diameter and shape factor SF-2 of primary particles of external additive B, as analyzed from toners 1 to 17 and comparative toners 1 to 8, were the same as the values shown in Table 1.

TABLE 3

| | | External additive B | | | | External addition step | | | Heating step | | |
|---|---|---|---|---|---|---|---|---|---|---|---|
| | | Type | Number average particle diameter (nm) | SF-2 | Added amount (part) | Mixing process apparatus type | Conditions | Temp. (° C.) | Mixing process apparatus type | Conditions | Temp. (° C.) |
| Toner 1 | Toner particle 1 | Organic-inorganic composite fine particles 1 | 106 | 116 | 1.0 | 2 | 60 $S^{-1}$ 5 minutes | 30 | 1 | 2.5 $S^{-1}$ 10 minutes | 55 |
| Toner 2 | Toner particle 2 | Organic-inorganic composite fine particles 1 | 106 | 116 | 3.3 | 2 | 60 $S^{-1}$ 5 minutes | 30 | 1 | 2.5 $S^{-1}$ 10 minutes | 55 |
| Toner 3 | Toner particle 2 | Organic-inorganic composite fine particles 1 | 106 | 116 | 1.2 | 2 | 60 $S^{-1}$ 5 minutes | 30 | 1 | 2.5 $S^{-1}$ 10 minutes | 55 |
| Toner 4 | Toner particle 2 | Silica fine particles 1 | 100 | 100 | 5.0 | 2 | 60 $S^{-1}$ 5 minutes | 30 | 1 | 2.5 $S^{-1}$ 10 minutes | 55 |
| Toner 5 | Toner particle 1 | Organic-inorganic composite fine particles 1 | 106 | 116 | 1.0 | 2 | 60 $S^{-1}$ 12 minutes | 55 | — | — | — |
| Toner 6 | Toner particle 3 | Organic-inorganic composite fine particles 1 | 106 | 116 | 1.2 | 2 | 60 $S^{-1}$ 12 minutes | 55 | — | — | — |
| Toner 7 | Toner particle 3 | Organic-inorganic composite fine particles 1 | 106 | 116 | 1.2 | 2 | 60 $S^{-1}$ 12 minutes | 50 | — | — | — |
| Toner 8 | Toner particle 2 | Silica fine particles 2 | 180 | 120 | 3.0 | 2 | 60 $S^{-1}$ 12 minutes | 55 | — | — | — |
| Toner 9 | Toner particle 2 | Silica fine particles 3 | 40 | 101 | 0.7 | 2 | 60 $S^{-1}$ 12 minutes | 55 | — | — | — |
| Toner 10 | Toner particle 4 | Organic-inorganic composite fine particles 1 | 106 | 116 | 1.2 | 2 | 60 $S^{-1}$ 12 minutes | 55 | — | — | — |
| Toner 11 | Toner particle 5 | Organic-inorganic composite fine particles 1 | 106 | 116 | 0.9 | 2 | 60 $S^{-1}$ 12 minutes | 55 | — | — | — |
| Toner 12 | Toner particle 6 | Organic-inorganic composite fine particles 1 | 106 | 116 | 1.2 | 2 | 60 $S^{-1}$ 12 minutes | 55 | — | — | — |
| Toner 13 | Toner particle 1 | Silica fine particles 1 | 100 | 100 | 0.6 | 2 | 60 $S^{-1}$ 12 minutes | 55 | — | — | — |
| Toner 14 | Toner particle 1 | Silica fine particles 1 | 100 | 100 | 6.0 | 2 | 60 $S^{-1}$ 12 minutes | 55 | — | — | — |
| Toner 15 | Toner particle 1 | Silica fine particles 1 | 100 | 100 | 0.9 | 2 | 60 $S^{-1}$ 16 minutes | 55 | — | — | — |

TABLE 3-continued

| | | External additive B | | | | External addition step | | | Heating step | | |
|---|---|---|---|---|---|---|---|---|---|---|---|
| | | Type | Number average particle diameter (nm) | SF-2 | Added amount (part) | Mixing process apparatus type | Conditions | Temp. (° C.) | Mixing process apparatus type | Conditions | Temp. (° C.) |
| Toner 16 | Toner particle 7 | Organic-inorganic composite fine particles 1 | 106 | 116 | 1.2 | 2 | 60 $S^{-1}$ 12 minutes | 55 | — | — | — |
| Toner 17 | Toner particle 9 | Organic-inorganic composite fine particles 1 | 106 | 116 | 1.2 | 2 | 60 $S^{-1}$ 12 minutes | 45 | — | — | — |
| Comparative toner 1 | Toner particle 1 | Organic-inorganic composite fine particles 1 | 106 | 116 | 1.0 | 2 | 60 $S^{-1}$ 12 minutes | 40 | — | — | — |
| Comparative toner 2 | Toner particle 2 | Silica fine particles 4 | 210 | 125 | 10.5 | 2 | 60 $S^{-1}$ 12 minutes | 55 | — | — | — |
| Comparative toner 3 | Toner particle 2 | Silica fine particles 5 | 25 | 108 | 0.6 | 2 | 60 $S^{-1}$ 12 minutes | 55 | — | — | — |
| Comparative toner 4 | Toner particle 2 | Organic-inorganic composite fine particles 1 | 106 | 116 | 3.3 | 2 | 60 $S^{-1}$ 30 minutes | 40 | — | — | — |
| Comparative toner 5 | Toner particle 4 | Organic-inorganic composite fine particles 1 | 106 | 116 | 4.2 | 2 | 60 $S^{-1}$ 12 minutes | 40 | — | — | — |
| Comparative toner 6 | Toner particle 1 | Organic-inorganic composite fine particles 1 | 106 | 116 | 1.0 | 2 | 60 $S^{-1}$ 5 minutes | 30 | 1 | 2.5 $S^{-1}$ 10 minutes | 40 |
| Comparative toner 7 | Toner particle 1 | Organic-inorganic composite fine particles 1 | 106 | 116 | 1.0 | 2 | 60 $S^{-1}$ 5 minutes | 30 | 1 | 2.5 $S^{-1}$ 10 minutes | 45 |
| Comparative toner 8 | Toner particle 8 | Organic-inorganic composite fine particles 1 | 106 | 116 | 1.2 | 2 | 60 $S^{-1}$ 5 minutes | 30 | 1 | 2.5 $S^{-1}$ 10 minutes | 55 |

*In cases where there is no subsequent heating step, heating is carried out in the external addition step.

TABLE 4

| | | External additive B | | | Inorganic fine particles A | | | Toner cross section observation | | Nanoindenter | |
|---|---|---|---|---|---|---|---|---|---|---|---|
| | | Adhesion index | Coverage ratio (%) | Dispersion evaluation index (%) | Type | Surface abundance (%) | Nb/Na | Y/X | SD of Y/X (%) | B (N/m) | B/A |
| Toner 1 | Toner particle 1 | 1.25 | 21 | 0.35 | Magnetic body 1 | 65 | 0.51 | 0.25 | 10 | 1145 | 1.23 |
| Toner 2 | Toner particle 2 | 1.31 | 60 | 0.29 | Magnetic body 1 | 35 | 0.46 | 0.27 | 13 | 980 | 1.09 |
| Toner 3 | Toner particle 2 | 1.16 | 20 | 0.34 | Magnetic body 1 | 35 | 0.41 | 0.25 | 11 | 982 | 1.09 |
| Toner 4 | Toner particle 2 | 1.62 | 62 | 0.42 | Magnetic body 1 | 35 | 0.30 | 0.26 | 12 | 981 | 1.09 |
| Toner 5 | Toner particle 1 | 2.02 | 18 | 0.40 | Magnetic body 1 | 65 | 0.45 | 0.33 | 16 | 1148 | 1.23 |
| Toner 6 | Toner particle 3 | 2.26 | 20 | 0.45 | Magnetic body 1 | 24 | 0.23 | 0.35 | 17 | 963 | 1.07 |
| Toner 7 | Toner particle 3 | 2.68 | 19 | 0.44 | Magnetic body 1 | 24 | 0.21 | 0.27 | 17 | 960 | 1.07 |
| Toner 8 | Toner particle 2 | 2.59 | 20 | 0.52 | Magnetic body 1 | 35 | 0.28 | 0.31 | 19 | 980 | 1.09 |
| Toner 9 | Toner particle 2 | 1.93 | 22 | 0.36 | Magnetic body 1 | 35 | 0.43 | 0.36 | 24 | 981 | 1.09 |
| Toner 10 | Toner particle 4 | 2.33 | 20 | 0.46 | Magnetic body 1 | 15 | 0.22 | 0.33 | 17 | 944 | 1.06 |
| Toner 11 | Toner particle 5 | 2.26 | 19 | 0.42 | Magnetic body 1 | 75 | 0.53 | 0.35 | 18 | 1151 | 1.24 |
| Toner 12 | Toner particle 6 | 2.38 | 21 | 0.47 | Magnetic body 1 | 9 | 0.20 | 0.36 | 16 | 910 | 1.04 |
| Toner 13 | Toner particle 1 | 2.15 | 8 | 0.68 | Magnetic body 1 | 65 | 0.60 | 0.30 | 18 | 1144 | 1.23 |
| Toner 14 | Toner particle 1 | 2.88 | 82 | 0.34 | Magnetic body 1 | 65 | 0.45 | 0.31 | 17 | 1145 | 1.23 |

TABLE 4-continued

| | | External additive B | | | Inorganic fine particles A | | | Toner cross section observation | | | |
|---|---|---|---|---|---|---|---|---|---|---|---|
| | | Adhesion index | Coverage ratio (%) | Dispersion evaluation index (%) | Type | Surface abundance (%) | Nb/Na | Y/X | SD of Y/X (%) | Nanoindenter B (N/m) | B/A |
| Toner 15 | Toner particle 1 | 2.01 | 12 | 0.81 | Magnetic body 1 | 65 | 0.38 | 0.33 | 16 | 1140 | 1.23 |
| Toner 16 | Toner particle 7 | 2.30 | 20 | 0.45 | Magnetic body 2 | 20 | 0.30 | 0.35 | 17 | 940 | 1.06 |
| Toner 17 | Toner particle 9 | 2.14 | 20 | 0.45 | Magnetic body 1 | 9 | 0.24 | 0.34 | 16 | 680 | 1.04 |
| Comparative toner 1 | Toner particle 1 | 3.11 | 20 | 0.70 | Magnetic body 1 | 65 | 0.21 | 0.12 | 17 | 1145 | 1.23 |
| Comparative toner 2 | Toner particle 2 | 2.59 | 60 | 0.58 | Magnetic body 1 | 35 | 0.24 | 0.14 | 21 | 978 | 1.09 |
| Comparative toner 3 | Toner particle 2 | 1.93 | 21 | 0.25 | Magnetic body 1 | 35 | 0.45 | 0.52 | 33 | 980 | 1.09 |
| Comparative toner 4 | Toner particle 2 | 2.67 | 59 | 0.84 | Magnetic body 1 | 35 | 0.16 | 0.27 | 18 | 975 | 1.09 |
| Comparative toner 5 | Toner particle 4 | 4.33 | 72 | 0.62 | Magnetic body 1 | 15 | 0.11 | 0.10 | 15 | 943 | 1.06 |
| Comparative toner 6 | Toner particle 1 | 3.69 | 22 | 0.39 | Magnetic body 1 | 65 | 0.53 | 0.13 | 12 | 1147 | 1.23 |
| Comparative toner 7 | Toner particle 1 | 3.22 | 21 | 0.32 | Magnetic body 1 | 65 | 0.52 | 0.20 | 12 | 1142 | 1.23 |
| Comparative toner 8 | Toner particle 8 | 2.28 | 18 | 0.82 | Magnetic body 3 | 40 | 0.18 | 0.28 | 38 | 880 | 1.02 |

In the table, SD represents standard deviation.

Working Example 1

Toner 1 was filled in a cartridge (CF230X) for a HP printer (LaserJet Pro m203dw) that uses a cleaner-less system, and the following evaluations were carried out. The evaluation results are shown in Table 5.

<Evaluation of Image Density>

Image density was evaluated in a high temperature high humidity environment (temperature: 32.5° C., relative humidity: 80%). As a long-term durability test, and with one job being one sheet of a horizontal line pattern having a print percentage of 1%, a total of 7,000 sheets were printed in a mode whereby the machine was temporarily stopped between jobs. Image density was measured for the first print, the 3,000th print and the 7,000th print. A4 color laser photocopying paper (available from Canon, Inc., 80 g/m$^2$) was used. Image density was measured by measuring the reflection density of a solid round image having diameter of 5 mm using an SPI filter with a Macbeth densitometer (available from GretagMacbeth), which is a reflection densitometer. A higher numerical value indicates better developing performance.

<Evaluation of Image Density after being Left>

After 7,000 prints in the image density evaluation mentioned above, the cartridge was left for 3 days in a high temperature high humidity environment (temperature: 32.5° C., relative humidity: 80%). Next, a solid round image having diameter of 5 mm was printed and image density was evaluated.

<Evaluation of Low-Temperature Fixability>

Low-temperature fixability was evaluated in a normal temperature normal humidity environment (temperature: 25.0° C., relative humidity 60%). In the same way as in the image density evaluation, with one job being one sheet of a horizontal line pattern having a print percentage of 1%, a total of 7,000 sheets were printed in a mode whereby the machine was temporarily stopped between jobs. A low-temperature fixability test was carried out using the method described below for the first print, the 3,000th print and the 7,000th print.

The printer was modified so that the fixation temperature of the fixing apparatus could be arbitrarily set. Using this apparatus, the temperature of the fixing unit was adjusted at 5° C. intervals from 180° C. to 230° C., and half tone images having image densities of from 0.6 to 0.65 were printed using a rough paper (FOX RIVER BOND paper, 110 g/m$^2$). An obtained image was rubbed back and forth 5 times using a lens-cleaning paper to which a load of 4.9 kPa was applied, and low-temperature fixability was evaluated on the basis of the lowest temperature at which the rate of decrease in image density before and after the rubbing was 15% or less. A lower value for this temperature indicates better low-temperature fixability.

<Evaluation of Fogging>

Fogging was evaluated in a low temperature low humidity environment (temperature: 15° C., relative humidity: 10%) that is assumed to lead to a broad toner charge distribution and to be more severe for fogging. As a long-term durability test, and with one job being one sheet of a horizontal line pattern having a print percentage of 1%, a test was carried out by printing a total of 7,000 sheets in a mode whereby the machine was temporarily stopped between jobs. Fogging was measured for the first print, the 3,000th print and the 7,000th print. A4 color laser photocopying paper (available from Canon, Inc., 80 g/m$^2$) was used. Using a reflectometer (available from Tokyo Denshoku Co., Ltd.), the reflectance (%) of white background parts of a fixed image and the reflectance (%) of a transfer material were measured, and the difference between these reflectance values was calculated to be the fogging density (%). A lower fogging density is better.

<Evaluation of Transferability>

Transferability was evaluated in a high temperature high humidity environment (temperature: 32.5° C., relative humidity: 85%) that is assumed to be more severe for transferability. The evaluation paper was a rough paper (FOX RIVER BOND paper, 110 g/m$^2$). Transferability was evaluated by taping untransferred toner on a photosensitive member by means of Mylar Tape (product name, available from Nitto Denko Corporation) following transfer of a solid black image, and then tearing off. Here, the value of the Macbeth reflection density of the Mylar Tape bonded to the paper is denoted by C, the Macbeth density of the Mylar Tape bonded to the toner-bearing paper following transfer but prior to fixing is denoted by D, and the Macbeth density of the Mylar Tape bonded to unused paper is denoted by E. Transferability was calculated approximately using the formula below. A higher numerical value indicates better transferability.

$$\text{Transferability (\%)}=\{(D-C)/(D-E)\}\times 100$$

Working Examples 2 to 17, Comparative Examples 1 to 8

Evaluations were carried out in the same way as in Working Example 1. The evaluation results are shown in Table 5.

TABLE 5

| | | Image density (H/H) | | | Image density (H/H) after 7,000 prints and then | Low-temperature fixability (° C.) (N/N) | | | Fogging (° C.) (L/L) | | | Transfer-ability |
|---|---|---|---|---|---|---|---|---|---|---|---|---|
| | | First print | 3,000th print | 7,000th print | left for 3 days | First print | 3,000th print | 7,000th print | First print | 3,000th print | 7,000th print | (%) (H/H) |
| Example 1 | Toner 1 | 1.48 | 1.47 | 1.47 | 1.45 | 200 | 200 | 200 | 0.3 | 0.5 | 0.6 | 90 |
| Example 2 | Toner 2 | 1.48 | 1.46 | 1.43 | 1.42 | 205 | 205 | 205 | 0.3 | 0.3 | 0.4 | 95 |
| Example 3 | Toner 3 | 1.48 | 1.46 | 1.44 | 1.41 | 195 | 195 | 195 | 0.4 | 0.5 | 0.7 | 88 |
| Example 4 | Toner 4 | 1.47 | 1.43 | 1.41 | 1.35 | 200 | 200 | 205 | 0.5 | 0.8 | 0.8 | 92 |
| Example 5 | Toner 5 | 1.47 | 1.45 | 1.44 | 1.41 | 200 | 200 | 200 | 0.4 | 0.7 | 0.8 | 82 |
| Example 6 | Toner 6 | 1.47 | 1.42 | 1.37 | 1.36 | 195 | 195 | 200 | 0.5 | 0.6 | 0.8 | 83 |
| Example 7 | Toner 7 | 1.46 | 1.42 | 1.37 | 1.35 | 195 | 195 | 200 | 0.7 | 0.7 | 0.8 | 82 |
| Example 8 | Toner 8 | 1.45 | 1.39 | 1.35 | 1.33 | 195 | 195 | 200 | 1.0 | 1.3 | 1.7 | 85 |
| Example 9 | Toner 9 | 1.45 | 1.38 | 1.34 | 1.28 | 195 | 195 | 200 | 0.6 | 0.8 | 0.9 | 78 |
| Example 10 | Toner 10 | 1.48 | 1.39 | 1.32 | 1.30 | 195 | 195 | 200 | 0.7 | 0.8 | 0.9 | 82 |
| Example 11 | Toner 11 | 1.46 | 1.45 | 1.43 | 1.41 | 205 | 205 | 205 | 0.7 | 0.7 | 0.9 | 83 |
| Example 12 | Toner 12 | 1.46 | 1.35 | 1.30 | 1.28 | 190 | 190 | 195 | 0.5 | 0.8 | 0.8 | 82 |
| Example 13 | Toner 13 | 1.45 | 1.38 | 1.26 | 1.20 | 185 | 185 | 190 | 1.2 | 1.5 | 1.8 | 79 |
| Example 14 | Toner 14 | 1.48 | 1.45 | 1.42 | 1.35 | 210 | 210 | 210 | 0.6 | 0.6 | 0.9 | 80 |
| Example 15 | Toner 15 | 1.46 | 1.40 | 1.32 | 1.23 | 185 | 185 | 190 | 2.1 | 2.4 | 2.7 | 79 |
| Example 16 | Toner 16 | 1.46 | 1.43 | 1.38 | 1.36 | 195 | 195 | 200 | 0.6 | 0.8 | 0.9 | 81 |
| Example 17 | Toner 17 | 1.43 | 1.31 | 1.23 | 1.20 | 180 | 180 | 185 | 0.7 | 1.1 | 1.2 | 80 |
| Comparative example 1 | Comparative toner 1 | 1.46 | 1.28 | 1.02 | 0.98 | 200 | 205 | 205 | 1.3 | 1.5 | 2.1 | 90 |
| Comparative example 2 | Comparative toner 2 | 1.45 | 1.32 | 1.18 | 1.05 | 195 | 200 | 200 | 1.2 | 1.5 | 1.9 | 79 |
| Comparative example 3 | Comparative toner 3 | 1.44 | 1.21 | 1.05 | 0.94 | 195 | 200 | 200 | 0.4 | 0.7 | 0.9 | 80 |
| Comparative example 4 | Comparative toner 4 | 1.47 | 1.31 | 1.19 | 1.15 | 205 | 210 | 210 | 2.2 | 2.5 | 3.1 | 91 |
| Comparative example 5 | Comparative toner 5 | 1.47 | 1.32 | 1.18 | 1.14 | 205 | 210 | 210 | 1.3 | 1.6 | 1.9 | 91 |
| Comparative example 6 | Comparative toner 6 | 1.48 | 1.33 | 1.15 | 1.11 | 200 | 205 | 205 | 0.5 | 0.7 | 0.8 | 80 |
| Comparative example 7 | Comparative toner 7 | 1.48 | 1.37 | 1.19 | 1.14 | 200 | 200 | 205 | 0.4 | 0.7 | 0.9 | 79 |
| Comparative example 8 | Comparative toner 8 | 1.45 | 1.10 | 0.87 | 0.64 | 200 | 205 | 205 | 1.6 | 3.2 | 5.2 | 75 |

In the table, H/H represents high temperature high humidity environment, N/N represents normal temperature normal humidity environment, and L/L represents low temperature low humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-230658, filed Dec. 10, 2018 which is hereby incorporated by reference herein in its entirety.

What is claimed is:

1. A toner comprising:

a toner particle that comprises a binder resin, a colorant and inorganic fine particles A; and an external additive, wherein the external additive contains an external additive B, a number average particle diameter of primary particles of the external additive B is from 30 nm to 200 nm, an adhesion index of the external additive B to the toner particle is from 0.00 to 3.00, a number average particle diameter of primary particles of the inorganic fine particles A is greater than the number average particle diameter of primary particles of the external additive B, and in scanning electron microscope observations of the toner, when Na denotes the number of particles of the external additive B in a 2 μm square region of the toner surface, as obtained by image analysis of the toner surface at an accelerating voltage of 1.0 kV and Nb denotes the number of particles of the external additive B that observed in a state of overlapping with the inorganic fine particles A in a 2 μm square region of the toner surface, as obtained by image analysis of the toner surface at an accelerating voltage of 5.0 kV, a value of Nb/Na is at least 0.20.

2. The toner according to claim 1, wherein, in scanning electron microscope observations of the toner surface, a surface abundance of the inorganic fine particles A, as obtained by image analysis of the toner surface at an accelerating voltage of 5.0 kV, is from 10% to 70%.

3. The toner according to claim 1, wherein a coverage ratio of the toner particle surface by the external additive B is from 10% to 80%.

4. The toner according to claim 1, wherein a dispersion evaluation index of the external additive B at the toner particle surface is not more than 0.80.

5. The toner according to claim 1, wherein a shape factor SF-2 of the external additive B is from 103 to 120.

6. The toner according to claim 1, wherein the external additive B has at least one selected from the group consisting of silica fine particles and organic-inorganic composite fine particles.

7. The toner according to claim 1, wherein the inorganic fine particles A contain a magnetic body.

8. The toner according to claim 1, wherein, in a nanoindentation method, when the toner hardness A (N/m) is defined as an average inclination in a displacement region of from 0.0 μm to 0.20 μm when a load-displacement curve measured at a load application speed of 0.83 μN/sec has a load a (mN) as the vertical axis and a displacement amount b (μm) as the horizontal axis, and when a toner hardness B (N/m) is defined as an average inclination in a displacement region of from 0.0 μm to 0.20 μm when a load-displacement curve measured at a load application speed of 2.50 μN/sec has a load a (mN) as the vertical axis and a displacement amount b (μm) as the horizontal axis, the toner satisfies formulae (1) and (2) below:

$$B \geq 600 \quad (1)$$

$$B/A \geq 1.05 \quad (2).$$

9. The toner according to claim 1, wherein in a cross-sectional observation of the toner using a transmission electron microscope, when X (nm) denotes a maximum diameter of primary particles of the external additive B and Y (nm) denotes a maximum embedded length of the external additive B embedded in the surface of the toner particle, formula (3) below is satisfied, $$0.15 \leq Y/X \quad (3)$$

where, the maximum embedded length Y (nm) of the external additive B means the maximum length of a portion where the external additive B is embedded in the toner particle in a normal direction relative to a line that connects both ends of an interface between the surface of the toner particle and the external additive B, and a standard deviation of Y/X is not more than 20%.

10. A method for producing the toner according to claim 1, the production method comprising:

a step for obtaining a toner particle, an external addition step for mixing the toner particle with the external additive B so as to obtain a toner, and a heating step for heating the toner, wherein, when a glass transition temperature of the toner particle is denoted by Tg (° C.), a temperature $T_R$ in the heating step is such that $$Tg-10(°\ C.) \leq T_R \leq Tg+5(°\ C.).$$

* * * * *